United States Patent [19]

Shimada

[11] 4,430,977

[45] Feb. 14, 1984

[54] FUEL INJECTION PUMP FOR INTERNAL COMBUSTION ENGINES

[75] Inventor: Minoru Shimada, Shiga, Japan

[73] Assignee: Yanmar Diesel Engine Co., Ltd., Osaka, Japan

[21] Appl. No.: 237,884

[22] Filed: Feb. 25, 1981

[30] Foreign Application Priority Data

| | | | |
|---|---|---|---|
| Feb. 28, 1980 | [JP] | Japan | 55-25713 |
| Dec. 5, 1980 | [JP] | Japan | 55-172488 |
| Dec. 5, 1980 | [JP] | Japan | 55-175400 |
| Dec. 5, 1980 | [JP] | Japan | 55-175401 |
| Dec. 6, 1980 | [JP] | Japan | 55-175227 |
| Dec. 6, 1980 | [JP] | Japan | 55-175228 |
| Dec. 6, 1980 | [JP] | Japan | 55-175229 |
| Dec. 11, 1980 | [JP] | Japan | 55-178680 |
| Dec. 11, 1980 | [JP] | Japan | 55-178681 |
| Dec. 11, 1980 | [JP] | Japan | 55-178682 |
| Dec. 11, 1980 | [JP] | Japan | 55-178683 |
| Dec. 11, 1980 | [JP] | Japan | 55-178684 |

[51] Int. Cl.[3] ..... F02M 41/02

[52] U.S. Cl. ..... 123/449; 123/501; 123/509

[58] Field of Search ..... 123/451, 450, 449, 501, 123/495, 503, 509

[56] References Cited

U.S. PATENT DOCUMENTS

| | | | |
|---|---|---|---|
| 1,740,360 | 12/1929 | L'Orange | 123/495 |
| 2,935,062 | 5/1960 | Aldinger et al. | 123/450 |
| 4,168,689 | 9/1979 | Parr | 123/509 |
| 4,289,105 | 9/1981 | Noraberg | 123/503 |

*Primary Examiner*—Craig R. Feinberg

*Attorney, Agent, or Firm*—Charles A. Blank

[57] ABSTRACT

A fuel injection pump for internal combustion engines of the type having a plunger adapted to be reciprocatingly moved within a barrel to pressurize and deliver a fuel before the establishment of communication between a fuel relief bore formed in the wall of said barrel and a fuel pressurizing chamber, said plunger being adapted to be rotated relatively to said barrel to change the timing of establishment of said communication thereby to adjust the amount of the fuel delivered per stroke of said plunger.

Said fuel injection pump is provided with a plunger rotating member coupled to said plunger for rotation therewith.

Whereby said plunger can be rotated by merely rotating said plunger rotating member.

1 Claim, 24 Drawing Figures

FUEL INJECTION PUMP FOR INTERNAL COMBUSTION ENGINES

BACKGROUND OF THE INVENTION

The present invention relates to a fuel injection pump for internal combustion engines, of the type in which the rate of fuel delivery is adjusted by rotating a plunger within a plunger barrel. More particularly, the invention is concerned with an improvement in the device for rotating the plunger in the fuel injection pump of the type mentioned above.

A fuel injection pump called "Bosch" type fuel injection pump has been known. This fuel injection pump has a plunger adapted to be moved reciprocatingly in a plunger barrel (referred to simply as "barrel", hereinafter) to pressurize and deliver a fuel. The rate of delivery of the fuel is adjusted by changing the timing at which the fuel pressurizing chamber in the barrel is brought into communication with a fuel relief port formed in the wall of the barrel, through changing the relative rotational position relatively to each other. In this fuel injection pump, in order to cause the rotation of the plunger, there is provided a plunger rotating member which engaged in the circumferential direction with a projection provided at an intermediate portion of the plunger, and a rack gear disposed at one side of the plunger rotating member and meshing with the gear teeth formed on the outer periphery of the plunger rotating member. In operation, the rack gear is pulled and pushed to rotate the plunger rotating member, thereby to cause the rotation of the plunger.

Thus, this known fuel injection pump requires a combination of a plunger rotating member and a rack for rotating the plunger, resulting in a complicated construction and uneconomically raised cost of production of the fuel injection pump.

SUMMARY OF THE INVENTION

Under these circumstances, the present invention aims as its major object to provide a fuel injection pump having a single barrel, in which the plunger is rotated solely by a plunger rotating member, thereby to simplify the construction of the fuel injection pump and to reduce the cost of production of the same through the reduction of number of parts.

The present invention provides in its another aspect to provide a fuel injection pump having a multiplicity of barrels, in which the plungers are rotated by a combination of respective plunger rotating members and a fuel adjusting rod, thereby to simplify the construction of the fuel injection pump and to reduce the cost of production of the same through the reduction of the number of parts.

To this end, according to the invention, there is provided a fuel injection pump for internal combustion engines of the type having a plunger adapted to be reciprocatingly moved in a barrel to pressurize and deliver a fuel before the establishment of communication between a fuel pressurizing chamber and a fuel relief bore formed in the wall of the barrel, said plunger being adapted to be rotated relatively to the barrel to change the timing of establishment of the communication thereby to adjust the rate of delivery of said fuel, characterized by comprising a plunger rotating member coupled to said plunger for rotation together with the plunger, whereby the plunger is rotated as the plunger rotating member is rotated.

The foregoing and still other advantages of the invention will be made more apparent from the following detailed explanation of the preferred embodiments taken in conjunction with the accompanying drawings.

DESCRIPTION OF THE PREFERRED EMBODIMENTS

Figure 1:
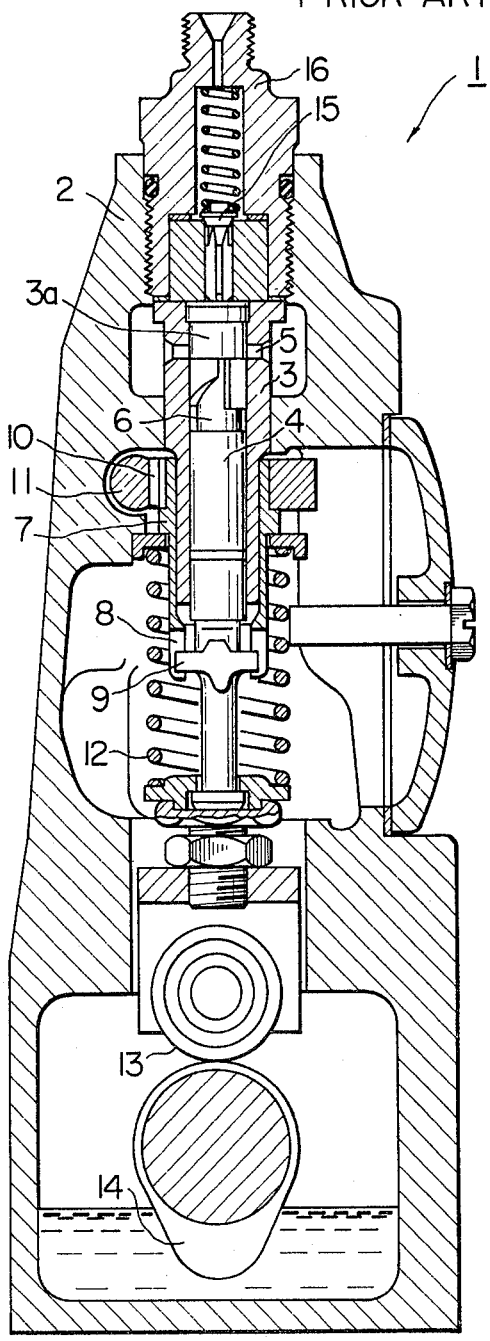
FIG. 1 PRIOR ART
FIG. 1 is a vertical sectional view of a conventional fuel injection pump.

Referring first to FIG. 1 showing a conventional Bosch type fuel injection pump, a pump casing 2 mounts a barrel 3 which reciprocatably and slidably receives a plunger 4 provided at its top with an inclined lead 6. The wall of the barrel 3 has a fuel relief port 5 of a small diameter. A plunger rotating member rotatably fitted around the barrel 3 has, at its lower part, a groove 8 which engages with a projection 9 formed at an intermediate portion of the plunger 4. The plunger rotating member 7 is provided on its outer peripheral surface with gear teeth 10 meshing with a rack gear 11 disposed at one side of the plunger rotating member 7. In FIG. 1, a reference numeral 3*a* denotes a fuel pressurizing chamber. A cam roller 13 connected to the lower end of the plunger 4 is adapted to be pressed against a fuel cam 14 by means of a plunger spring 12. A reference numeral 15 designates a delivery valve held by a delivery valve holder 16.

The conventional fuel injection pump having the construction outlined as above operates in a manner explained hereinbelow.

As the engine on which the fuel injection pump starts to run, the fuel cam 14 is rotated to reciprocatingly move the plunger 4 within the barrel 3 through the medium of the cam roller 13, thereby to pressurize the fuel sucked into the fuel pressurizing chamber. For adjusting the rate of delivery of the fuel from the pump, the rack gear 11 is moved in one and the other direction to rotate the plunger 4 through the action of the plunger rotating member 7, thereby to change the timing at which the inclined lead 6 is brought into communication with the fuel relief port 5. The fuel thus metered is delivered at a high pressure to a fuel injection valve (not shown) through a delivery valve 15.

Thus, in the fuel injection pump, it is necessary to incorporate a combination of a plunger rotating member 7 and a rack gear 11 for rotating the plunger. Accordingly, the construction of the fuel pump itself is complicated and the cost of production of the same is uneconomically raised due to a large number of parts.

The above-described problems of the prior art is fairly overcome by the fuel injection pump of the present invention.

Figure 2:
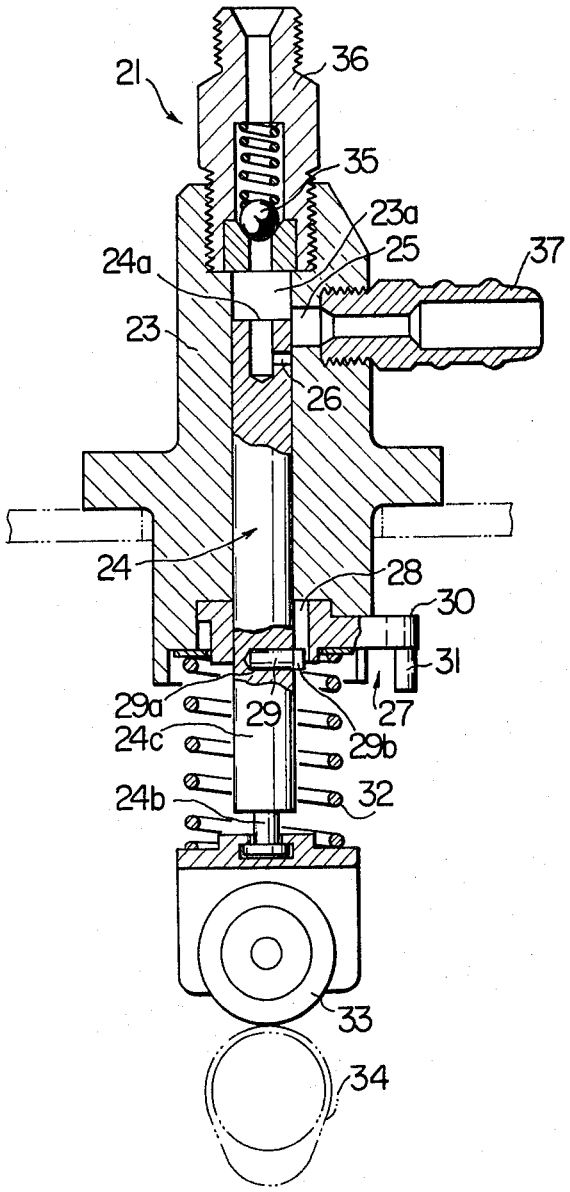
FIG. 2 is a vertical sectional view of a fuel injection pump constructed in accordance with a first embodiment of the present invention.
Figure 3:
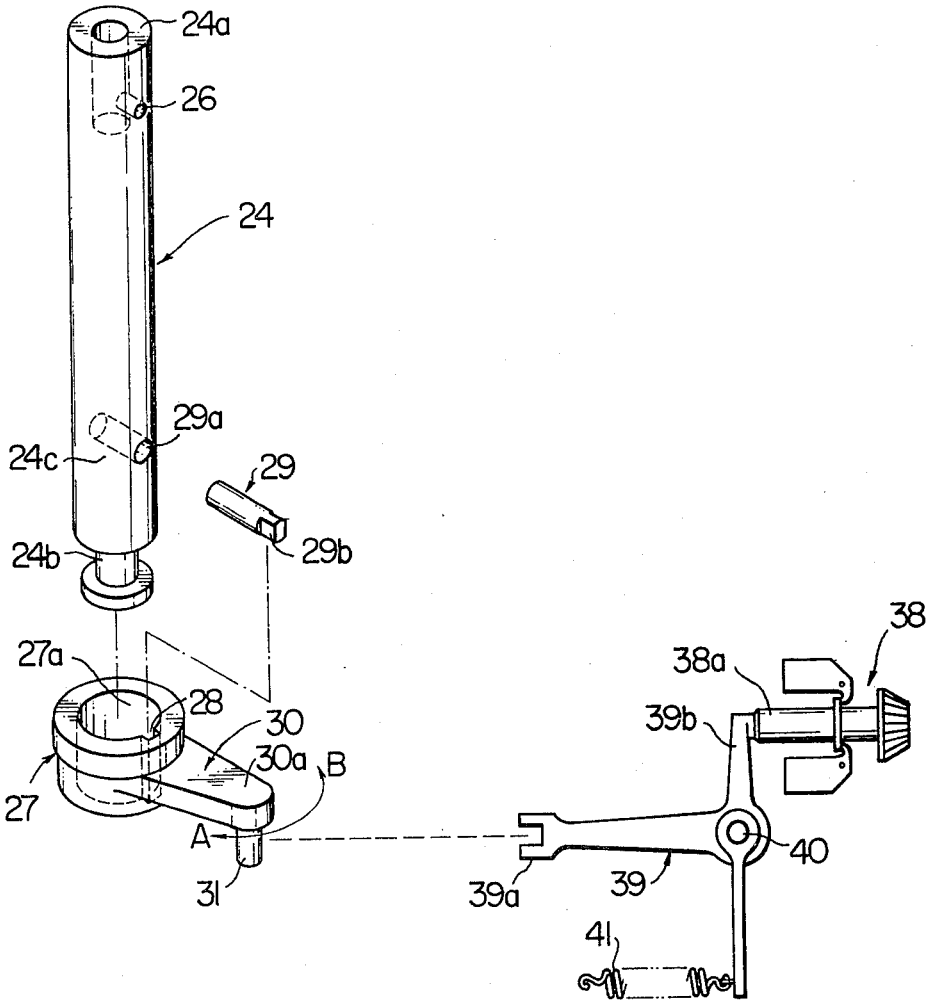
FIG. 3 is an exploded perspective view of an essential part of the fuel injection pump shown in FIG. 2.

FIGS. 2 and 3 show a fuel injection pump constructed in accordance with a first embodiment of the invention. Referring to FIG. 2, a plunger 24 is reciprocatingly received by a barrel 23 which also serves as a pump casing. The reciprocating motion of the plunger 24 is caused by a fuel cam 34 which cooperates with a cam roller 33 attached to the lower end of the plunger 24. This fuel injection pump as a whole is generally designated at a reference numeral 21. A fuel relief port 25 having a circular or elliptic shape and acting also as a fuel suction port is formed in the wall of the barrel 23. On the other hand, the plunger 24 has a fuel relief bore 26 opening at the top and side surfaces thereof. The rate of delivery of the fuel from this pump is adjusted by varying the timing at which the fuel relief bore 26, i.e. the pressurizing chamber 23*a*, is brought into communication with the fuel relief port 25, through rotating the plunger 24 relatively to the barrel 23. Thus, the fuel injection pump of this first embodiment is of the type so-called "Bosch" type fuel injection pump.

At an intermediate portion 24*c* of the plunger 24, formed is a pin bore 29*a* extending from the outer peripheral surface toward the axis of the plunger 24, as will be understood from FIG. 3. Furthermore, a pin 29 of a suitable length is forcibly fitted into the pin bore 29*a*, so that the portion of the pin 29 projected out of the outer peripheral surface of the plunger constitutes a projection 29*b*. The projection 29*b* has flattened two vertical side surfaces which are extended in parallel with the axis of the plunger and acting as sliding surfaces. The projection 29*b* engages with a later-mentioned groove 28 formed in a plunger rotating member 27.

On the other hand, a plunger rotating member having a cylindrical form is fitted around an intermediate portion 24*c* of the plunger 24 in such a manner as to cover or conceal the projection 29. The plunger rotating member 27 is provided in its inner peripheral surface with a groove 28 adapted for receiving the projection 29*b* in such a manner as to permit the projection 29*b* to slidingly move in the axial direction within the groove 28. Thus, the plunger 24 is slidable in the axial direction of the plunger rotating member 27 but is prevented from rotating relatively to the latter due to the mutual engagement of the projection 29*b* and the groove 28.

The plunger rotating member 27 is provided at its one side with a lever member 30 projected unitarily therewith. An engaging pin 31 attached to the end of the lever member 30 engages one end 39*a* of an adjusting lever 39 the other end 39*b* of which is connected to a centrifugal governor 38. The adjusting lever 39 is mounted on a pin 40 and is rotatively biased by a spring 41 such that its end 39*b* is pressed against an operating member 38*a* of the centrifugal governor 38.

Therefore, the plunger rotating member 27 is rotatively movable in the direction of arrows A-B in accordance with the displacement of the operating member 38*a* of the centrifugal governor 38. In FIG. 2, a reference numeral 32 designates a plunger spring adapted for pressing a cam roller 33 against a fuel cam 34, while a reference numeral 35 designates a delivery valve held by a delivery valve holder 36. The fuel is sucked through a fuel suction pipe denoted by a reference numeral 37.

The fuel injection pump 21 of the first embodiment described heretofore operates in a manner explained hereinbelow.

The plunger 24 is moved reciprocatingly up and down within the barrel 23, by the cam action of the fuel cam, so that the fuel sucked through the fuel suction/-relief port 25 of the barrel into the fuel pressurizing chamber 23*a* is pressurized and delivered to the fuel injection valve (not shown) through a fuel delivery valve 35. During the reciprocating motion of the plunger 24, the projection 29*b* on an intermediate portion of the plunger is reciprocatingly slided in the axial direction along the groove 28 of the plunger rotating member 27.

During the operation of the fuel injection pump 21, the rate of delivery of the fuel is adjusted in a manner explained below. As the load imposed on the engine is changed, the centrifugal governor 38 operates correspondingly to displace the operation member 38*a* thereof. As a result of the displacement of the operating member 38*a*, the adjusting lever 39 is swung around the pin 40. Consequently, the plunger rotating member 27 is rotated in the direction of the arrows A, B because it is connected through the pin 31 to one end 30*a* of the adjusting lever 30, so that the plunger 24, having the projection 29*b* received by the groove 28 of the plunger rotating member 27 in such a manner as to be able to slide in the axial direction but not to rotate relatively to the plunger rotating member, is rotated together with the plunger rotating member 27. In consequence, the timing at which the fuel relief port 25 in the barrel 23 is communicated with the fuel relief bore 26 opening in the top 24*a* of the plunger 24 and in the peripheral surface of the same is changed to vary the effective stroke length of the plunger 24 and, hence, the rate of delivery of the fuel.

The invention is applicable not only to the fuel injection pump of the type having a fuel metering mechanism constituted by a circular or elliptical fuel relief port 25 of a substantial diameter and a circular fuel relief bore 26 of the small diameter as in the case of illustrated embodiment, but also to fuel injection pump of the type having, as shown in FIG. 1, a fuel metering mechanism constituted by a fuel relief port 5 of small diameter formed in the barrel 3 and an inclined lead 6 provided in the plunger.

As will be understood from the foregoing description, in the fuel injection pump of the first embodiment, the projection provided on the peripheral surface of the plunger is engaged in the circumferential direction by the plunger rotating member directly fitting the plunger, and the plunger rotating member is rotated by an external governor mechanism thereby to rotate the plunger relatively to the barrel. Therefore, the number of parts is reduced to lower the production cost and the construction is simplified to facilitate the disassembling and assembling of the fuel injection pump.

Figure 4:
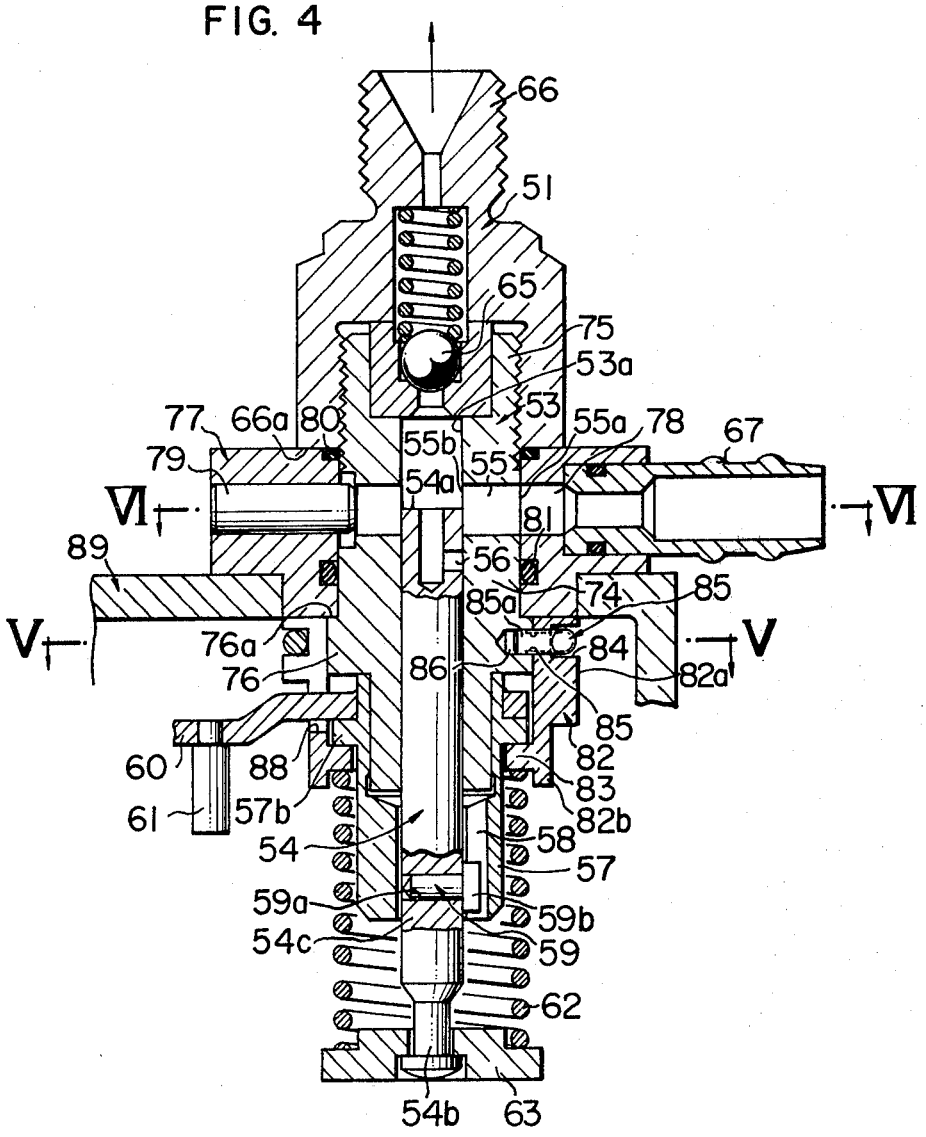
FIG. 4 is a vertical sectional view of a fuel injection pump constructed in accordance with a second embodiment of the invention.
Figure 5:
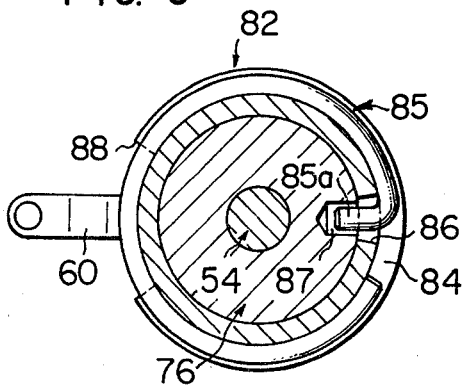
FIG. 5 is a sectional view taken along the line V—V of FIG. 4.
Figure 6:
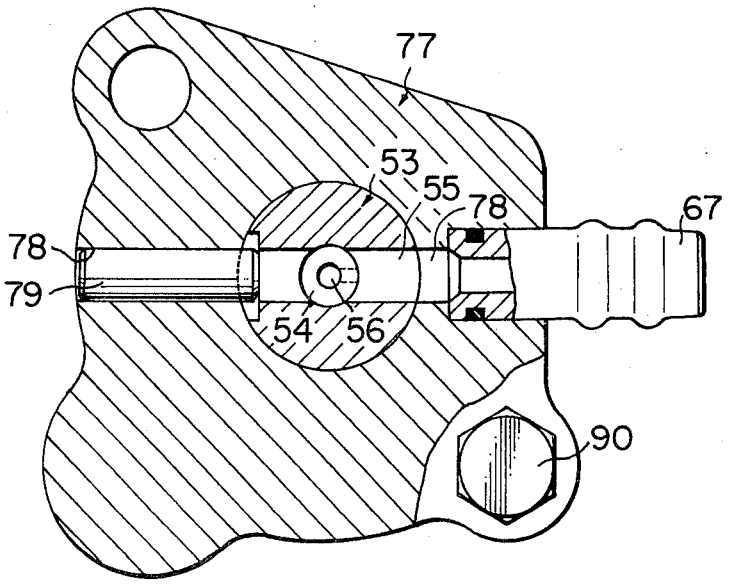
FIG. 6 is a sectional view taken along the line VI—VI of FIG. 4.

FIGS. 4 thru 6 in combination show a second embodiment of the invention having a specific mechanism for supporting the plunger rotating member, in which a plunger rotating member similar to that of the first embodiment is supported by a cylindrical member detachably secured to the pump body acting also as the barrel, so that the disassembling and assembling of the fuel injection pump is very much facilitated.

Another feature of this second embodiment resides in that the barrel constituting the pump body and a mounting flange for mounting the barrel on the engine are formed in separate bodies. The flange member is clamped between the barrel and the delivery valve holder screwed to the barrel thereby to further facilitate the disassembling and assembling, as well as the manufacturing, of the fuel injection pump.

Referring to FIG. 4, there is shown the fuel injection pump of the second embodiment of the invention designated generally at a reference numeral 51. In this embodiment, a plunger 54 is moved reciprocatingly in a plunger receiving bore 53*a* formed in a barrel 53 serving also as a pump body, thereby to pressurize and deliver the fuel. The rate of fuel delivery is adjusted by varying the timing at which a fuel relief port 55 formed in the barrel 53 is brought into communication with a fuel relief bore 56 formed in the plunger 54 and opening in the top surface 54*a* of the plunger. Thus, the fuel injection pump of this embodiment is also of the type generally referred to as "Bosch" type fuel injection pump.

The barrel 53 has a cylindrical form of a suitable length with the plunger receiving bore 53*a* formed axially in the latter. At an intermediate of the barrel 53, formed is the aforementioned fuel relief port so as to open at its one side in the outer peripheral surface of the barrel as at 55*a* and to the inner peripheral surface of the same at its other end as at 55*b*. The fuel relief port 55 serves also as a fuel suction port and has a circular or elliptic form.

The barrel 53 is provided with a screw thread portion 75 for screwing a delivery valve holder 66 for holding the delivery valve 65, as well as a flange portion 76 of a diameter greater than that of the intermediate portion 74 of the barrel 53. The delivery valve holder 66 and the flange 76 are formed at the upper side and lower side of the intermediate portion 74 of the barrel 53, respectively. Also, a tabular mounting flange member 77 for mounting the fuel injection pump is fitted around the intermediate portion between the flange 76 and the thread portion 75. The mounting flange member 77 is provided with a radial through bore 78 of the same diameter as the fuel relief port 55.

The through bore 78 of this mounting flange 77 is located to be aligned and communicated with the fuel relief port 55 of the barrel 53, and is closed at its one end with a plugging pin 79 while the other end is connected to a fuel suction pipe 67. The delivery valve holder 66 is screwed to a threaded portion 75 formed at the upper end of the barrel 53 so that the mounting flange member 77 is clamped between the upper end surface 76*a* of the flange 76 of the barrel 53 and the lower end surface 66*a* of the delivery valve holder 66, so that it is unitarily and detachably fixed to the barrel 53. Reference numerals 80 and 81 denote sealing members.

On the other hand, a radial pin bore 59*a* is formed at an intermediate portion 54*c* of the plunger 54 so as to penetrate the plunger 54 in the radial direction thereof. At the same time, a head-equipped pin 59 of a suitable length is forcibly fitted into the pin bore 59*a* such that the head of the pin 59 projects outward from the outer peripheral surface of the plunger to form a projection 59*b*. This projection 59*b* has flattened side surfaces extending in the axial direction of the plunger, and is slidably received by a vertical groove 58 formed in the inner peripheral surface of a cylindrical plunger rotating member 57 rotatably fitting around the lower end portion of the barrel 53, so as to be able to slide up and down within the vertical groove 58 as the plunger 54 moves up and down reciprocatingly but to prevent relative rotation between the plunger rotating member 57 and the plunger 54.

A reference numeral 60 designates a lever member fixed to the plunger rotating member 57. This lever member is connected, through an engaging pin 61 fixed thereto, to a governor (not shown), so as to rotate the plunger 54 through the medium of the plunger rotating member 57, in accordance with the displacement of an operation member of the governor. The plunger rotating member 57 is supported by a cylindrical member 82 which fits the outer peripheral surface of the flange 76 of a barrel 53 form the lower side in such a manner as to cover the flange 57*b* formed at an upper end of the plunger rotating member 57.

More specifically, the upper end 82*a* of the cylindrical member 82 fits around the outer peripheral surface of the flange 76 of the barrel 53, in such a state that the upper end surface of an annular projection 83 acting also as a spring retainer and formed at the lower end 82*b* of inner peripheral surface engages with the lower end surface of the flange 57*b* of the plunger rotating member 57. At the same time, as shown in FIG. 5, a C-shaped stopper ring 85 fits in a stopper ring groove 84 formed in the outer peripheral surface of the upper end portion 82*a* of the cylindrical member 82 and having a suitable depth. The stopper ring 85 has a bent end 85*a* which is inserted into a pin bore 86 formed to extend radially from the bottom of the ring groove 84 and further into a pin bore 87 which is formed in the flange 76 of the barrel 53 in such a manner as to be aligned and communicated with the pin bore 86. Thus, the cylindrical member 82 is detachably connected to the barrel 53 and rotatably supports the plunger rotating member 57.

In this state, the lever member 60 of the plunger rotating member 57 is projected outwardly from a sector-shaped window hole 88 formed in the peripheral wall of the cylindrical member 82 opposing to the pin bore 86. A plunger spring 62 acts between the annular projection 83 of the cylindrical member 82 and a spring retainer 63 provided at the lower end portion 54*b* of the plunger 54, so as to always bias the plunger 54 downwardly.

The fuel injection pump having the described construction is mounted on the engine with its mounting flange 77 resting on a pump mount 89 formed on the engine. The mounting flange 77 is tightly fixed to the pump mount 89 by means of bolts 90, as will be seen from FIG. 6.

The fuel injection pump of this embodiment operates in the following manner. As the fuel cam (not shown) is rotated, the plunger 54 is reciprocatingly moved in the plunger receiving bore 53*a* of the barrel 53 up and down, so that the fuel sucked into the bore 53*a* through the fuel suction/relief port 56 of the barrel is pressurized by the plunger 54 and delivered to a fuel injection valve (not shown) through a delivery valve 65. The rate of delivery of the fuel is adjusted by varying the timing of establishment of communication between the relief port 56 in the plunger 54 and the fuel relief bore 55 of the barrel, through rotation of the plunger 54 through the medium of the lever 60 of the plunger rotating member 57.

The fuel injection pump 51 of this embodiment offers an advantage that, since the plunger rotating member 57 rotatably fitting around the lower end of the barrel 53 is supported by the cylindrical member 82 detachably secured to the barrel 53 by means of the C-shaped stopper ring 85, it is possible to easily attach and detach the plunger rotating member to and from the barrel 53 simply by attaching and detaching the C-shaped stopper ring 85, so that the disassembling and assembling of the fuel injection pump 51 is considerably facilitated.

As a modification, it is possible to use a pin in place of the C-shaped stopper ring 85. By so doing, it is possible to reduce the number of steps of the manufacturing process as compared with the case where the C-shaped stopper ring is used, because it is not necessary to form the ring groove 84 in the cylindrical member 82.

In addition, since the barrel constituting the pump body is formed separately from the mounting flange and since the mounting flange is clamped between the flange formed on the periphery of the barrel and the delivery valve holder which is screwed to the barrel, it is possible to easily connect and disconnect the barrel and the mounting flange by attaching and detaching the delivery valve holder to and from the barrel, so that the disassembling and assembling of the fuel pump is facilitated considerably. It is possible to prevent the barrel from being dropped accidentally from the mounting flange during the attaching and detaching of the delivery valve holder, by arranging such that the plugging pin fitting in one end of the through bore in the mounting flange is projected into the fuel relief bore of the barrel.

In addition, since the barrel is formed separately from the mounting flange, the size of the barrel is reduced and the shape of the same is simplified, followed by an advantage that, when the barrel is heat-treated (quenched), it is possible to uniformly treat the whole portion of the barrel, particularly the inner peripheral surface thereof. Another advantage resides in that it is possible to make a suitable selection of the materials. For instance, it is possible to form the barrel, which generally requires a high resistance to wear, from a chromium-molybdenum steel or the like high-class alloy, while forming the mounting flange, which generally requires not so high strength and wear resistance, from a light alloy such as an aluminum alloy. Such a suitable selection of the materials contributes to the reduction of the cost of production of the fuel injection pump.

Figure 7:
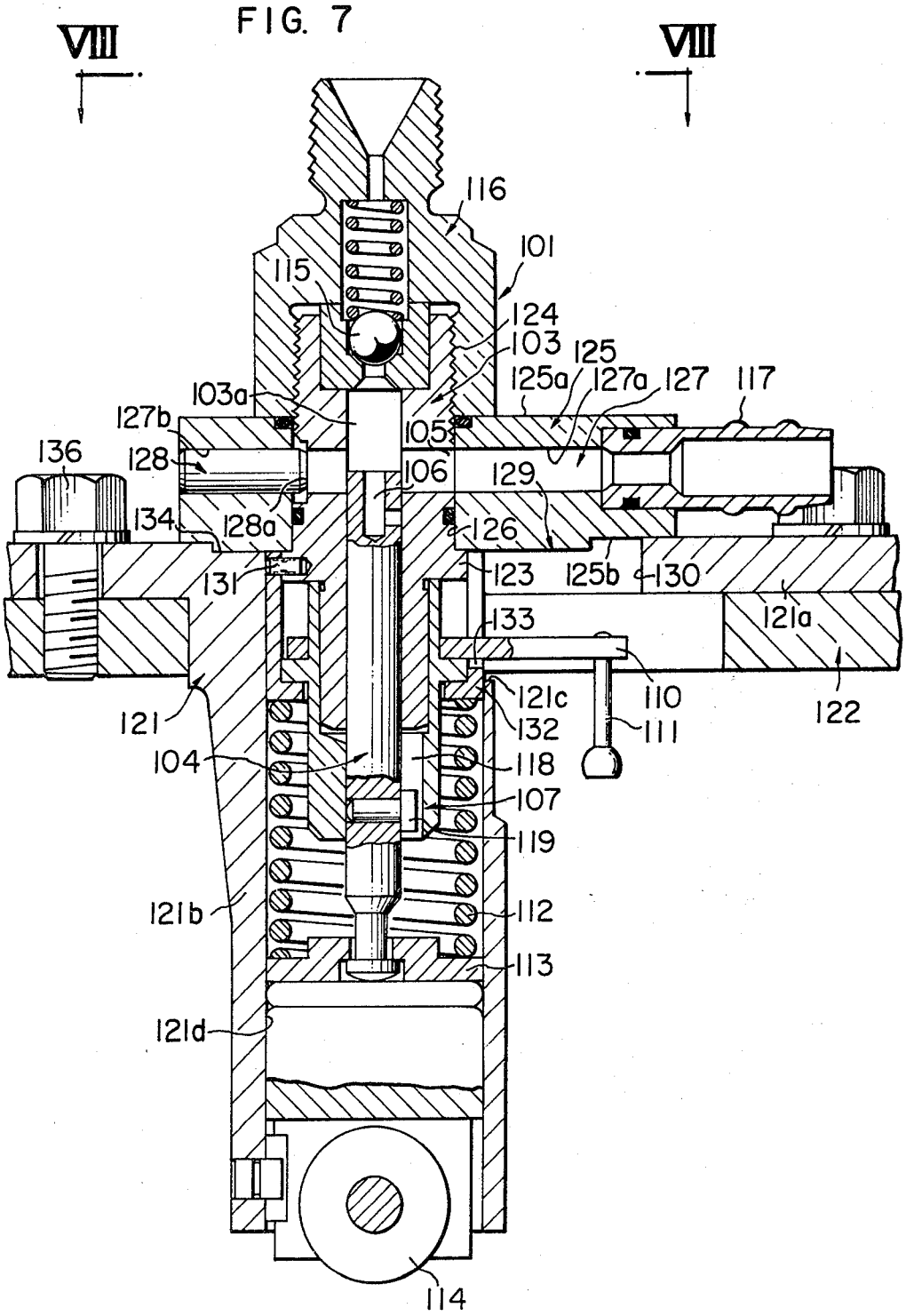
FIG. 7 is a vertical sectional view of a fuel injection pump constructed in accordance with a third embodiment of the invention.
Figure 8:
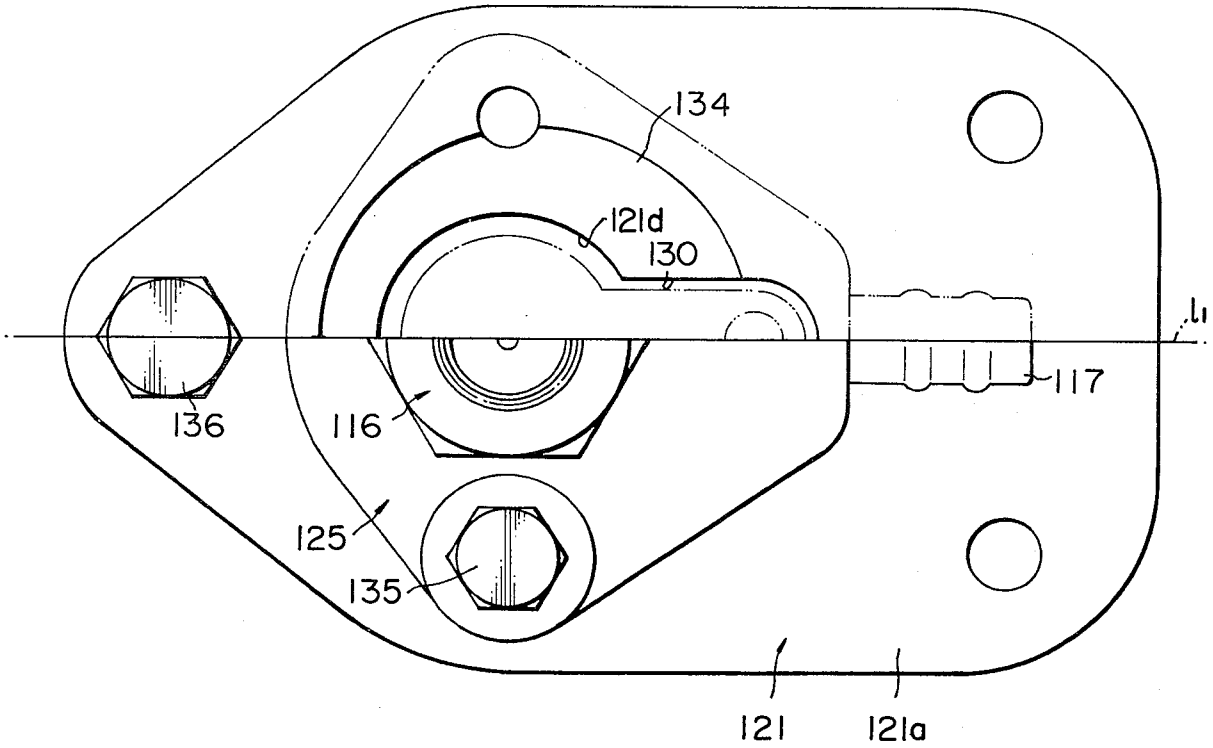
FIG. 8 is a view taken in the direction of arrow lines VIII—VIII of FIG. 7.

FIGS. 7 and 8 designate a third embodiment of the invention in which the number of parts is reduced to lower the production cost of the fuel injection pump by arranging such that the mounting flange for fixing the barrel constituting the pump body to the pump mount of the engine function also as the cover for closing the lever receiving bore in the pump mount and as a member providing a fuel passage.

Referring to FIG. 7, a fuel injection pump of this embodiment, generally designated at a reference numeral 101, has a plunger 104 adapted to reciprocatingly move in a plunger receiving bore 103*a* formed in a barrel 103 so as to pressurize and deliver the fuel through a delivery valve 115. The rate of delivery of the fuel is changed by changing the timing of establishment of the communication between a fuel relief port 105 formed in the barrel 103 and a fuel relief bore 106 formed in the plunger 104, through rotating the plunger 104 relatively to the barrel 103. Thus, the fuel injection pump of this embodiment is also of the type called "Bosch" type fuel injection pump. This fuel injection pump 101 is mounted on the engine body 122 by means of a pump mount 121.

The barrel 103 is constituted by a cylindrical member of a suitable length and having the axially-extending plunger receiving bore 103*a*. At an intermediate portion of the barrel 103, formed is a fuel relief port 105 so as to penetrate the wall of the barrel 103 in the radial direction. The fuel relief port 105 acts also as a fuel suction port. A flange 123 and a screw thread 124 are formed at the upper and lower sides of the intermediate portion of the barrel 103 where the fuel relief port 105 is formed. A later-mentioned mounting flange 125 is fitted to the portion between the flange 123 and the thread 124.

As will be seen from FIGS. 7 and 8, the mounting flange 125 is a substantially pentagonal flat member of a suitable thickness. A pump receiving bore 126 for receiving the barrel 103 is formed at a portion of the mounting flange 125 offset by a suitable distance from the center of the mounting flange 125. The mounting fange 125 is provided with a fuel passage 127 of a suitable length extending radially through the pump receiving bore along a straight line $l_1$ which interconnects the center of the mounting flange 125 and the center of the pump receiving bore 126. The mounting flange 125 is placed between the flange 123 and the threaded portion 124 of the barrel, with its fuel passage 127 aligned and communicated with the fuel relief port 105 of the barrel 103, and is detachably fastened to the barrel 103 by means of a delivery valve holder 116 which is screwed to the threaded portion 124 of the barrel. A plugging pin 128 of a suitable length is press-fitted into the offset-side end of the pump receiving bore of the fuel passage 127 to close the end 127*b*. The end 128*a* of the plugging pin 128 projects into the fuel relief port 105 of the barrel 103 to prevent the barrel from being accidentally dropped from the mounting flange 125 when the delivery valve holder 116 is detached from the barrel 103.

A fuel suction pipe 117 is secured to the other end of the fuel passage 127. Furthermore, a circular protrusion 129 of a suitable outside diameter is formed on the lower end surface 125*b* of the mounting flange 125. The protrusion 129 is formed on the aforementioned straight line $l_1$ at a suitable offset from the pump receiving bore 126. This circular protrusion 129 functions as a locating member for locating the mounting flange 125 when the latter is attached to the pump mount 121. The size of the mounting flange 125 is suitably selected such that, when the mounting flange 125 is secured to the pump mount 121, the lower side 125*b* of the mounting flange 125 covers the lever receiving bore 130 formed in the pump mount.

On the other hand, a plunger rotating member 107, having a vertical groove 118 engaging a projection 119 formed on an intermediate portion of the plunger 104, is slidably fitted around the lower end portion of the barrel 103. A lever 110 is attached to the upper end of the plunger rotating member 107. The arrangement is such that the plunger 104 is rotated relatively to the barrel 103 by means of the plunger rotating member 107, through the engagement between the vertical groove 118 and the projection 119, as the lever 110 is rotated. The plunger rotating member is rotatably supported by a cylindrical member 132 which in turn is detachably secured to the outer peripheral surface of the flange 123 of the barrel 103 by means of a pin 131. The lever 110 is projected outwardly from the opening 133 formed in the cylindrical member 132, in the same direction as the direction of projection of the fuel suction pipe 117 secured to the mounting flange 125.

The rotation lever 110 is connected by means of a pin 111 to a governor (not shown) so as to be able to rotatively drive the plunger 104 in accordance with the operation of the governor.

A reference numeral 113 designates a spring retainer attached to the lower end of the plunger 104. A plunger spring 112 interposed between the spring retainer 113 and the lower end of the cylindrical member 132 acts to normally bias the spring retainer 113 downwardly.

The fuel injection pump 101 having the described construction is secured to the engine body 122 through the pump mount 121. As will be understood from FIGS. 7 and 8, the pump mount 121 is constituted by a flange portion 121*a* having a substantially rectangular form and a cylindrical portion 121*b* projected downwardly from the flange portion 121*a*. The peripheral wall of the cylindrical portion 121*b* is suitably cut at its upper end portion to provide an opening 121*c* which permits the aforementioned lever 110 to project outwardly therethrough. The inner peripheral surface 121*d*, which constitutes a bore for receiving the spring retainer, has a constant diameter from the lower end thereof up to the upper face of the flange portion 121*a*. A circular recess 134 of a suitable depth, mating with the aforementioned circular protrusion 129 of the mounting flange 125, is formed on the upper surface of the flange portion 121*a*, at a suitable offset from the bore 121*d* for receiving the spring retainer. A lever receiving bore 130 is formed at one side of the receiving bore 121*d* so as to extend along the aforementioned straight line $l_1$ and in communication with the receiving bore 121*d*.

For mounting the fuel injection pump 101 on the pump mount 121, the fuel injection pump 101 is inserted into the bore 121*d* from the end of the latter adjacent to the flange 121*a* to make the circular protrusion 129 of the mounting flange 125 be seated in the circular recess 134 of the pump mount 121. At the same time, the mounting flange 125 is tightened to the flange portion 121*a* of the pump mount 121 by means of bolts 135.

Since the circular protrusion 129 of the mounting flange 125 and the circular recess 134 of the pump mount 121 are offset, respectively, from the bore 126 of the barrel 103 and the bore 121*d* of the pump mount 121, the circular protrusion 129 and the circular recess 134 act as locating members for locating the fuel injection pump 101 with respect to the pump mount 121. Thus, the fuel injection pump 101 is correctly positioned in relation to the pump mount 121 in both of horizontal and rotational directions, simply by aligning the circular protrusion 129 with the circular recess 134. In FIG. 7, a reference numeral 114 denotes a cam roller, while a numeral 136 denote bolts. The operation of the fuel injection pump of this embodiment is not described here because it is materially identical to that of the preceding embodiments.

In this embodiment, the fuel passage for supplying the fuel into the barrel is formed in the mounting flange for mounting the barrel on the pump mount. At the same time, the shape and size of the mounting flange are so selected suitably that the lever receiving bore formed in the pump mount is covered by the mounting flange. Thus, the mounting flange plays not only the role of the flange for fixing the barrel but also the roles of the member for providing the fuel passage and the member for closing the lever receiving bore. Consequently, it becomes not necessary to provide specific members for providing the fuel passage and the member for closing the lever receiving bore. Accordingly, the number of parts is reduced to contribute to the reduction of cost of production of the fuel injection pump.

In addition, the circular protrusion formed on the lower side of the mounting flange at an offset from the axis of the pump axis and a circular recess formed in the pump mount fit with each other to function as locating members for correctly locating the fuel injection pump with respect to the pump mount in both of horizontal direction and rotational direction, when the fuel pump is attached to the pump mount. As a result, the work for attaching and detaching the fuel injection pump to and from the pump mount is facilitated to improve the efficiency of the work for disassembling and assembling the fuel injection pump.

FIGS. 9 thru 12 in combination show a fourth embodiment of the invention. In the preceding embodiments 1 to 3, the plunger rotating member is operatively connected to the plunger through an engagement between the projection provided at an intermediate portion of the plunger and the vertical groove formed in the inner peripheral surface of the plunger rotating member so that the plunger is rotated together with the plunger rotating member. This fourth embodiment differs from these preceding embodiments in that the plunger rotating member is directly fixed to the lower end of the plunger.

More specifically, this fourth embodiment is characterized in that the mounting flange for fixing the pump barrel to the engine is unitarily secured to the barrel, by plastically deforming a part of the mounting flange and fitting the deformed portion of the mounting flange into a peripheral groove formed in the outer peripheral surface of the barrel, thereby to obtain a uniform quenching effect of the pump barrel and to facilitate the processing and assembling works.

Figure 9:
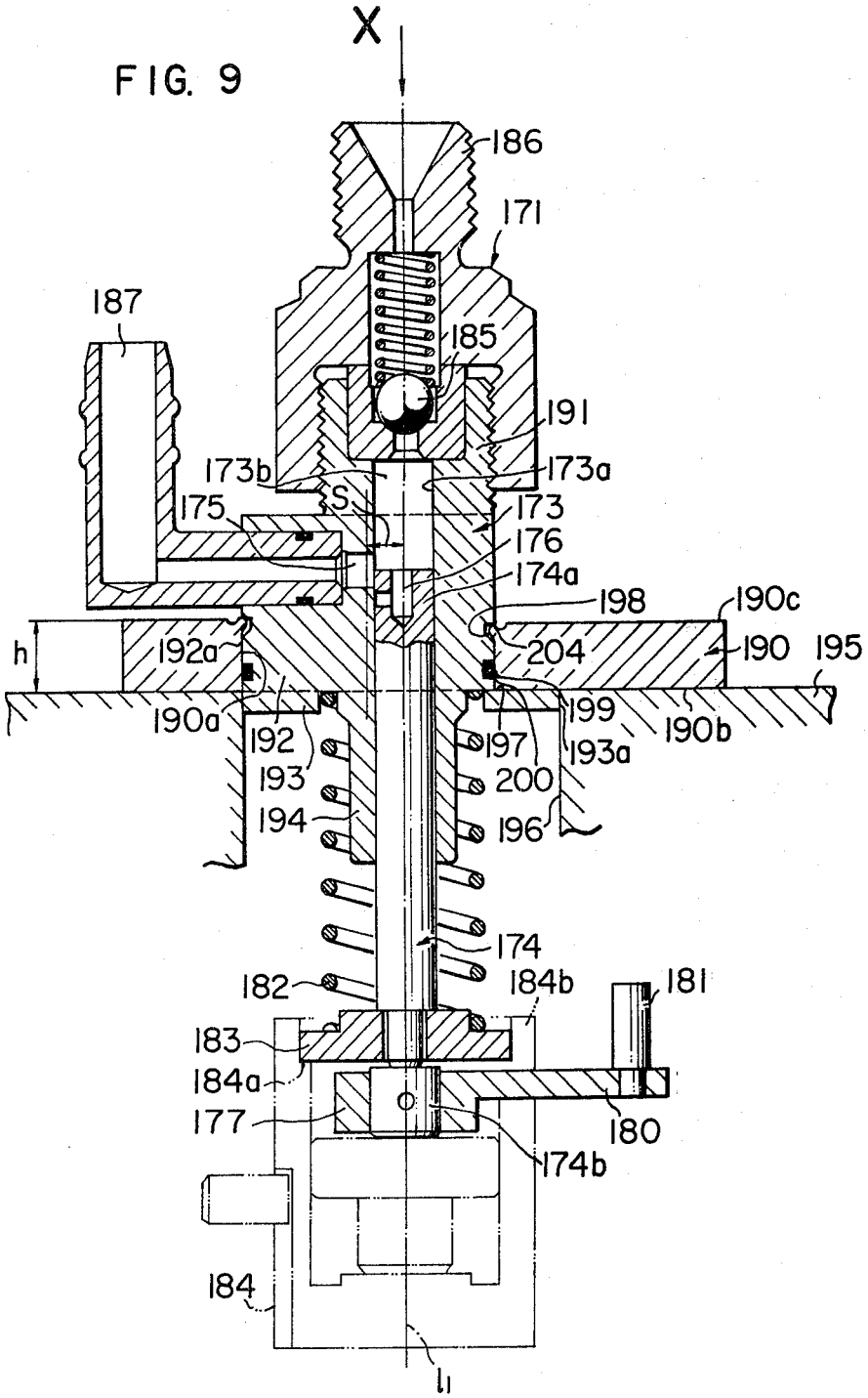
FIG. 9 is a vertical sectional view of a fourth embodiment of the invention.
Figure 10:
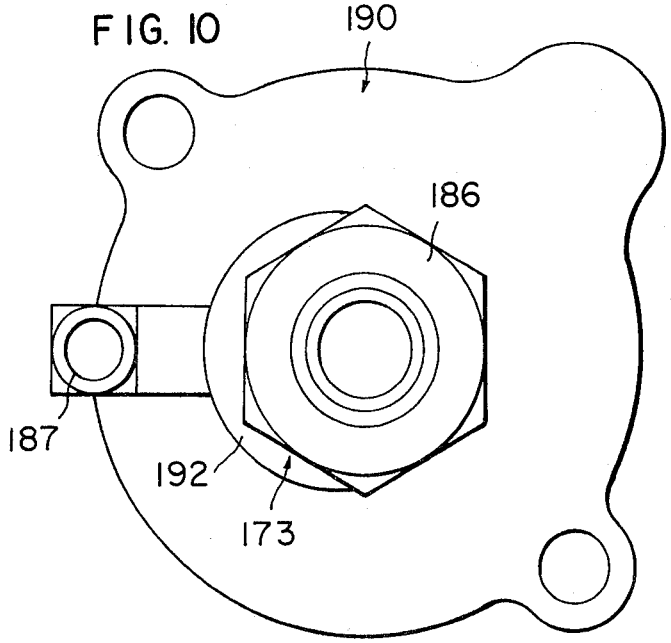
FIG. 10 is a view taken in the direction of arrow line X of FIG. 9.

Referring to FIG. 9, the fuel injection pump 171 of the fourth embodiment has a plunger 174 adapted to be reciprocatingly moved in a plunger receiving bore 173*a* formed in a barrel 173 constituting the pump body, so as to pressurize and deliver the fuel. The rate of delivery of the fuel is adjusted by varying the timing of establishment of communication between a fuel relief port 175 formed in the barrel 173 and a fuel relief bore 176 opening in the top of the plunger 174, through rotating the plunger 174 relatively to the barrel 173. Thus, the fuel injection pump of this fourth embodiment is also of the type so-called "Bosch" type fuel injection pump. A delivery valve 185 is attached to the upper end portion of the barrel 173, while a spring retainer 183 on which the plunger spring 182 acts is secured to the lower end of the barrel 173. The spring retainer 183 is made to engage with the lower end 174*b* of the plunger 174 to which the plunger rotating member 177 is fixed. The plunger 174 is adapted to be moved up and down reciprocatingly by a tappet 184 cooperating with a fuel cam (not shown), so as to pressurize the fuel sucked into a fuel pressurizing chamber 173*b* and deliver the same through the delivery valve 185 to a fuel injection valve (not shown). The rate of delivery of the fuel is adjusted as the plunger rotating member is rotated by means of a lever 180 which in turn is connected to the governor (not shown) through an engaging pin 181. The spring retainer 183 is seated in a recess 184*a* formed in the upper end of the tappet 184. The tappet 184 is provided also with an arcuate window 184*b* adapted to permit the lever 180 to be rotated. In the drawings, reference numerals 186 and 187 denote, respectively, a delivery valve holder and a fuel suction pipe.

Figure 12:
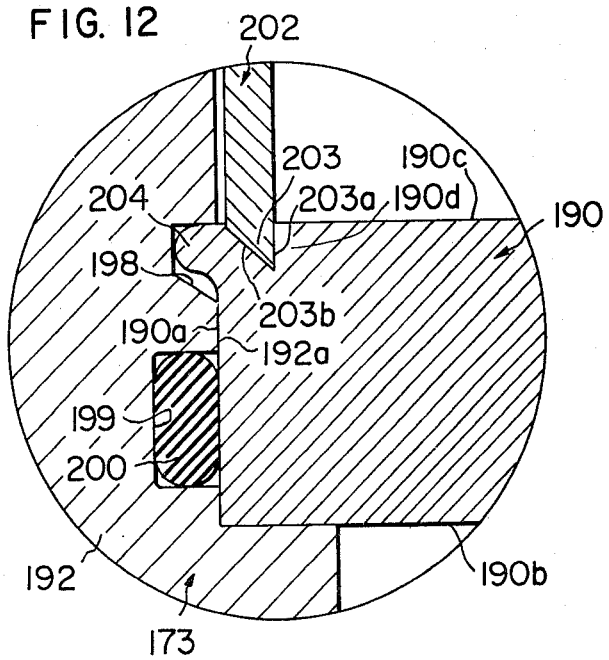
FIG. 12 is an enlarged view of the portion marked at XII of FIG. 11.

Hereinunder, an explanation will be made as to the shape of the barrel 173 and as to the connection between the barrel 173 and the mounting flange 190, with specific reference to FIGS. 11 and 12. The barrel 173 is quench-hardened and has a shape constituted by a plurality of cylinders 191, 192, 193, 194 superposed one on the other in the axial direction. Only the cylinder 192 of the second stage is offset by a distance S from the axis $l_1$ of the barrel. The cylinder 191 of the uppermost stage 191 has an external thread to which the aforementioned delivery valve holder 186 is screwed. The cylinder 193 of the third stage has an outside diameter greater than that of the cylinder of the second stage, and acts as a portion fitting the pump mounting hole 196 of the engine body 195. Namely, the outer peripheral surface 193*a* of the cylinder 193 fits in the pump mounting hole 196 formed in the engine body. Thus, the cylinder of the third stage will be referred to as "fitting portion", hereinafter. The cylinder 192 of the second stage, interposed between the uppermost cylinder 191 and the fitting portion 193, constitutes a portion to which the aforementioned mounting flange 190 is attached. A step 197 is formed between the cylinder 192 of the second stage and the fitting portion 193 having the larger diameter. The cylinder 192 of the second stage will be referred to as "flange-attaching portion", hereinafter. Thus, the outer peripheral surface 192*a* of the cylinder 192 of the second stage presents a fitting surface adapted to fit in a pump fitting bore 190*a* formed in the mounting flange 190. Thus, this outer peripheral surface will be referred to as flange-bore fitting surface. A peripheral groove 198 of a suitable width and depth are formed at an intermediate portion of the flange-bore fitting surface 192*a*. This peripheral groove 198 is adapted to receive a plastically deformed portion of the mounting flange 190 fitting around the flange-bore fitting surface 192*a*, and is formed at a position spaced upwardly from the step 197 by a distance corresponding to the thickness h of the flange 190. A reference numeral 199 designates a sealing ring fitting groove formed at a portion of the flange attaching portion near the lower end of the latter. This sealing ring groove 199 receives an "O" ring 200.

Figure 11:
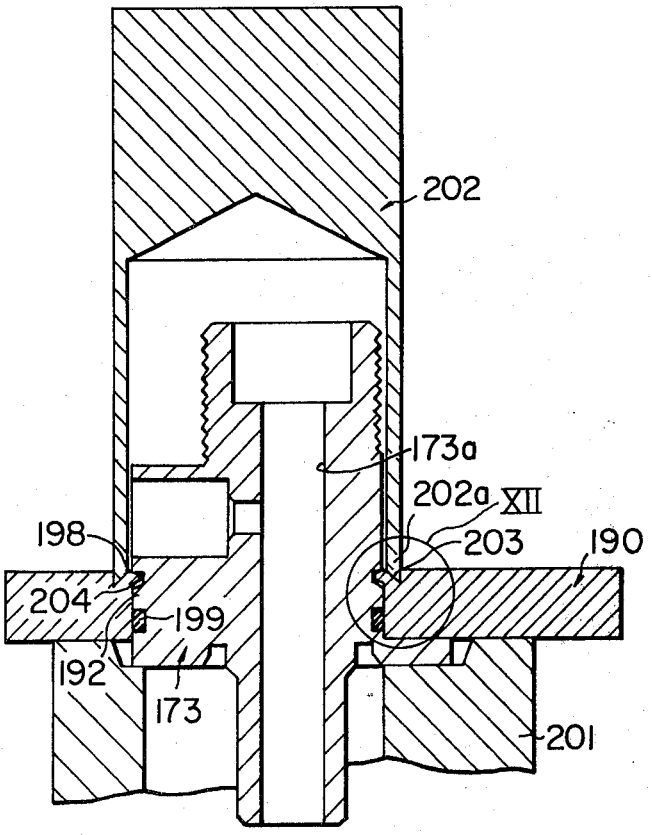
FIG. 11 is a vertical sectional view showing the structure for connecting the plunger barrel unit to a mounting flange.

Around the flange-bore fitting surface 192*a* of the flange attaching portion 192, fitted is the above-mentioned mounting flange 190 with its lower side 190*b* contacting the step 197, as shown in FIG. 11. In this state, as will be seen from FIG. 12, the peripheral groove 198 of the flange attaching portion 192 is opposed by the peripheral edge 190*d* of the barrel fitting bore 190*a* adjacent to the upper face 190*c* of the flange. At the same time, the degree of fitting of the flange-bore fitting surface 192*a* of the flange attaching portion 192 to the pump fitting bore 190*a* of the mounting flange 190 is suitably selected to diminish the play therebetween, as much as possible.

The barrel 173 to which the flange member 190 is fitted in a manner stated above is placed on a suitable chisel bed 201 as shown in FIG. 11. On the other hand, a tubular chisel 202 having an annular cutting edge 203 is placed at the outside of the flange attaching portion 192. The annular cutting edge 203 has a diameter which is greater than the inside diameter of the pump fitting bore 190*a*, and is positioned in contact with the peripheral edge 190*d* of the barrel fitting bore 190*a*. The annular cutting edge 203 has a wedge-shaped cross-section constituted by a vertical outer peripheral surface 203*a* and an inclined surface 203*b* inclined outwardly and downwardly.

With the annular cutting edge 203 contacting the peripheral edge 190*d* of the pump fitting bore 190*a* of the mounting flange 190, the tubular chisel 202 is hit or pressed downwardly by means of a hammer or a press, so that the annular cutting edge 203 of the tubular chisel 202 is driven into the peripheral edge 190*d* of the pump fitting bore. In consequence, the peripheral edge 190*d* of the pump fitting bore is plastically deformed outwardly toward the center of the pump fitting bore 190*a* by the action of the inclined surface 203*b* of the annular cutting edge 203. The plastically deformed portion is then forced into the aforementioned peripheral groove 198 positioned to oppose to the peripheral edge 190*d* of the pump fitting bore, as will be seen from FIG. 15.

This plastically deformed portion 204 filling the peripheral groove 198 effectively prevents the mounting flange 190 from being moved in the axial direction of the barrel. Thus, the mounting flange 190 is unitarily fixed to the pump barrel 173. It will be seen that, in the fuel injection pump of this embodiment, it is possible to unit the barrel 173 and the mounting flange 190, simply by plastically deforming the peripheral edge of the pump fitting bore 190*a* of the mounting flange 190 into the peripheral groove 190 formed in the flange-bore fitting surface 192*a*.

As will be understood from the foregoing description, in this fourth embodiment of the invention, the mounting flange and the pump barrel are united with each other simply by fitting the flat mounting flange around the barrel and plastically deforming, by means of a chisel or the like, a portion of the mounting flange into the peripheral groove formed in the outer peripheral surface of the pump body. Therefore, the processing and assembling works are simplified to lower the cost of the production of the fuel injection pump as a whole.

In addition, since the connection between the barrel and the mounting flange is achieved by making use of a plastic deformation of the mounting flange, it is not necessary to use specific connecting members such as bolts, so that the number of parts is reduced to lower the cost of production of the fuel injection pump as a whole.

Furthermore, since the barrel and the mounting flange are formed as separate bodies, it is possible to form the barrel and the mounting flange by suitable materials matching the conditions of use. The cost of production is lowered by a suitable selection of the materials.

It is also to be pointed out that, in the event that the barrel is quench-hardened, it is possible to obtain a more uniform quenching effect as compared with the conventional one having a mounting flange formed integrally with the barrel. In the case where the barrel constitutes the pump body as is the case of the illustrated embodiment, it is possible to uniformly heat-treat the plunger receiving bore.

Figure 13:
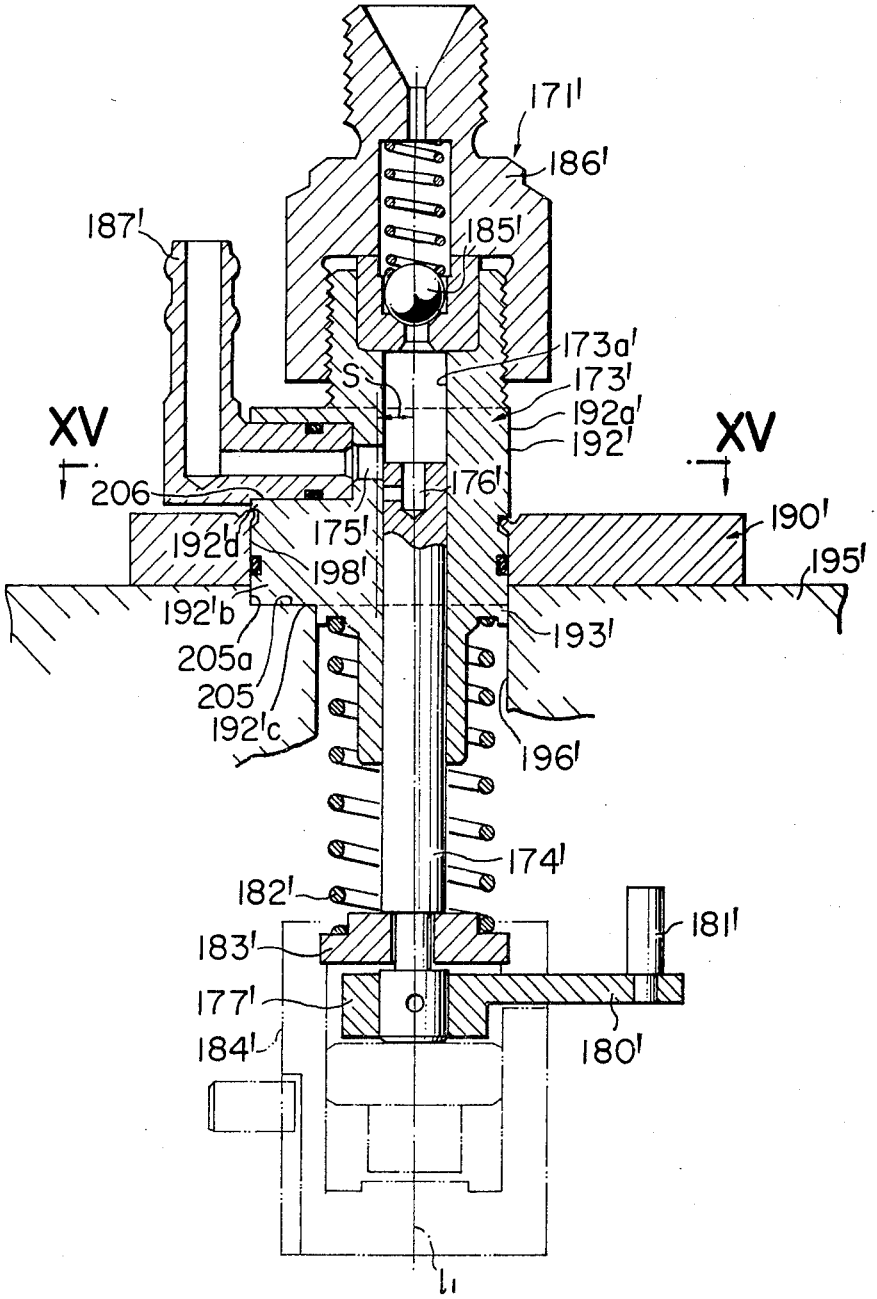
FIG. 13 is a vertical sectional view of a fuel injection pump constructed in accordance with a fifth embodiment of the invention.
Figure 14:
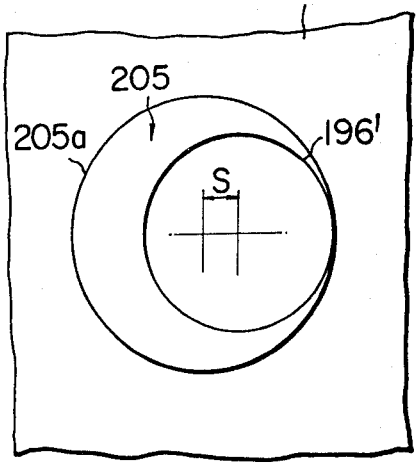
FIG. 14 shows a pump mounting hole formed in an internal combustion engine.
Figure 15:
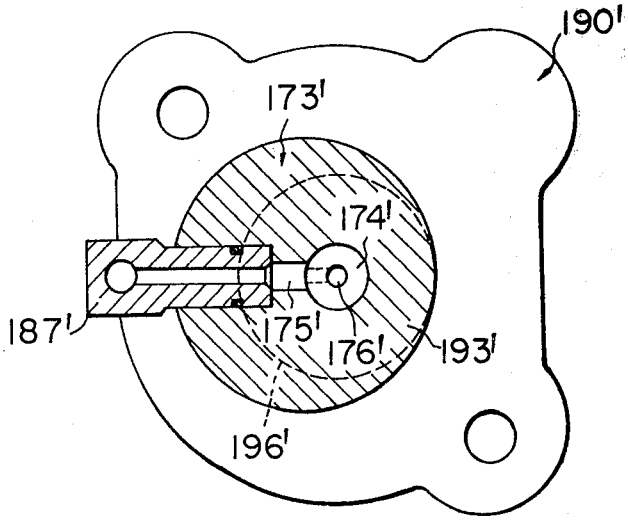
FIG. 15 is a sectional view taken along the line XV—XV of FIG. 13.

FIGS. 13 to 15 show a fifth embodiment of the invention in which an eccentric fitting surface formed on the periphery of the barrel constituting the pump body is utilized as the locating member for mounting the pump body to the engine and as a member for securing a fuel suction pipe, thereby to facilitate the mounting of the fuel injection pump on the engine and to reduce the size of the pump body.

This embodiment is materially identical to the fourth embodiment, excepting the construction for mounting the pump body on the engine. Therefore, in FIGS. 13 to 15, the same reference numerals with a suffix ′ are used to denote the same or corresponding members as those of the fourth embodiment, and the detailed description of these members are omitted.

In the fourth embodiment, the cylinder 193 of the third stage, i.e. the fitting portion 193, is formed to have a diameter greater than the cylinder of the second stage, i.e. the flange attaching portion 192, and a step 197 is formed between the fitting portion 193 and the flange attaching portion 192. The lower side of the mounting flange 190 is made to contact with the upper face of the step 197.

In contrast, in the fifth embodiment, the flange attaching portion 192′ corresponding to the flange attaching portion 192 of the fourth embodiment is made to have a greater diameter than the third cylinder 193′ constituting the fitting portion 193′ corresponding to that 193 of the fourth embodiment. In addition, the flange attaching portion 192′ of the fifth embodiment differs from the flange attaching portion 192 of the fourth embodiment in that it has a portion **192′*b* projecting downward below the mounting flange 190′**.

A pump mounting bore 196′ for tightly receiving the fitting portion 193′ is formed in the engine body 195′. At the same time, a pump mounting seat 205 for closely receiving and holding the downward projection **192′*b* of the flange attaching portion 192′ of the pump body 173′ is formed just above the pump mounting bore 196′**.

As will be seen from FIG. 14, the peripheral wall **205*a* of the pump mounting seat 205 is offset by a distance S from the axis of the pump mounting bore 196′** and envelopes the latter.

For mounting the fuel injection pump 171′ on the engine body 195′, the downward projection **192′*b* of the eccentric flange attaching portion 192′ is tightly fitted to the pump mounting seat 205, so that the latter functions as the member for locating the fuel injection pump 171′ and as the member for preventing the rotation of the same. The downward projection 192′*b* has a thickness corresponding to the depth of the pump mounting seat 205, so that, when the mounting flange 190′ is caulked and fixed to the flange attaching portion 192′, the mounting flange 190′ is spaced upward from the lower end surface 192′*c* of the lower projection 192′*b* by a distance corresponding to the depth of the pump mounting seat 205**.

On the other hand, the fuel suction pipe 187′ is fitted in a suction pipe attaching bore 206 formed in the thick-walled portion 192′ of the eccentric flange attaching portion 192′, immediately above the mounting flange 190′, and is communicated with the plunger receiving bore **173′*a* through the aforementioned fuel relief port 175′ formed in the barrel 173′*a*. The fuel injection pump of this embodiment is mounted on and fixed to the engine body 195′ in such a state that the fitting portion 193′ of the barrel 173′ fits in the pump mounting bore 196′ of the engine body 195′ and that the downward projection 192′*b* of the flange attaching portion 192′ is seated on the pump mounting seat 205. In this state, the mounting flange 190′ is fastened to the engine body 195′ by means of bolts which are not shown, thereby to fix the fuel injection pump 171′ to the engine body 195′. In this embodiment, the flange attaching portion 192′ which is offset by a suitable distance S from the axis of the barrel serves, in cooperation with the pump mounting bore fitting portion 193′ formed on the barrel axis, as the member for locating the fuel injection pump in the rotational direction and as the member for preventing the rotation of the same. It is, therefore, possible to easily mount the fuel injection pump 171′ on the engine body 195′**.

In the described embodiment, the eccentric flange attaching portion 192′ acting as locating and rotation-prevention member plays an additional role of a member for securing the fuel suction pipe. Namely, the fuel suction pipe 187′ is directly attached to the thick-walled portion of the flange attaching portion 192′, so that it is possible to obtain a sufficiently large thickness for holding the fuel suction pipe. At the same time, positioning the fuel suction pipe 187′ as close as possible to the axis of the fuel injection pump 171′, it is possible to reduce the maximum diameter of the fuel injection pump 171′ to obtain a compact construction of the latter.

The first to fifth embodiments described heretofore are single barrel type fuel injection pump having only one barrel. The invention, however, is applicable also to multi-barrel type fuel injection pumps. A typical example of such an application, as a sixth embodiment of the invention, will be described hereinafter with reference to FIGS. 16 to 19.

Figure 17:
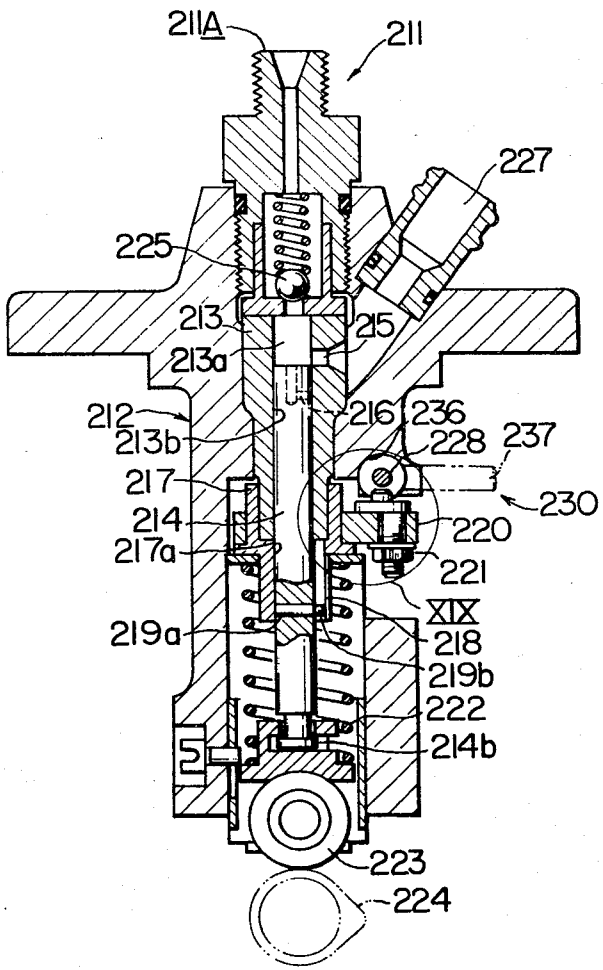
FIG. 17 is a sectional view taken along the line XVII—XVII of FIG. 16.
Figure 16:
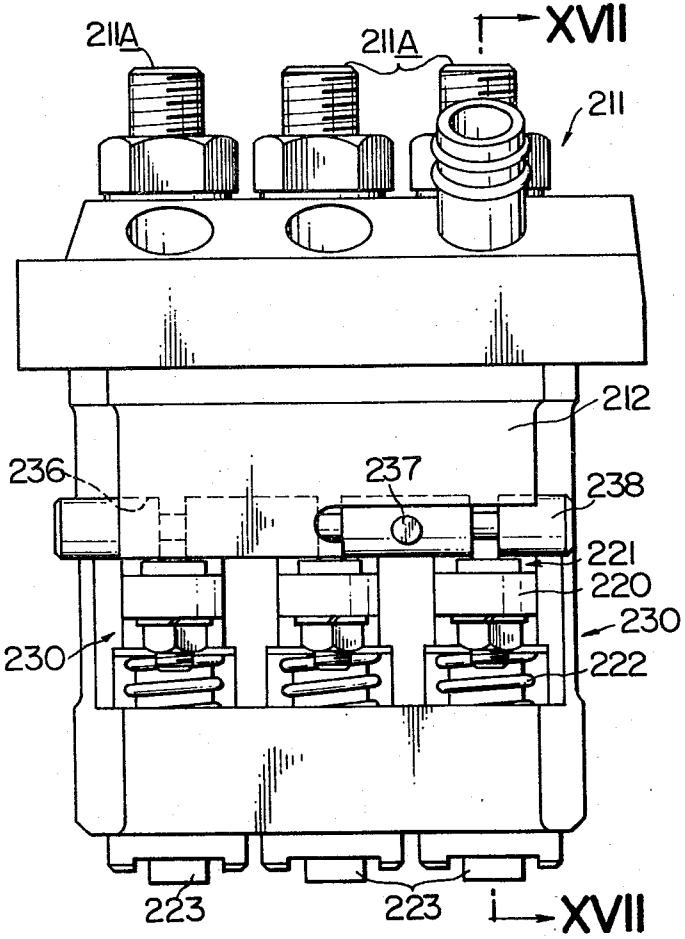
FIG. 16 is a front elevational view of a fuel injection pump constructed in accordance with a sixth embodiment of the invention.

FIGS. 16 and 17 in combination show a fuel injection pump 211 having three fuel injection pump units each having one barrel.

Each pump unit has a plunger 214 adapted to be reciprocatingly moved in a plunger receiving bore **213*b* of the barrel 213, by the operation of a fuel cam 224, thereby to suck the fuel into a fuel pressurizing chamber 213***a* through a fuel suction pipe 227 and to pressurize the thus sucked fuel in the fuel pressurizing chamber 213*a*. The pressurized fuel is delivered to a fuel injection valve (not shown) through the delivery valve 225. The rate of delivery of the fuel is controlled by varying the timing of establishment of communication between a fuel relief port 215 formed in the wall of the barrel 213 and a fuel relief bore 216 opening in the top surface 214*a* of the plunger and the side surface of the same, through rotating the plunger in the circumferential direction relatively to the barrel 213 within the latter, by means of a plunger rotating mechanism 230 provided at the lower end portion of the barrel 213. Thus, the fuel injection pump of this embodiment also is of the type so-called "Bosch" type fuel injection pump. The fuel injection pump of this embodiment is constituted by three fuel injection pump units 211A arranged in a side-by-side relation at a suitable pitch within a common pump casing 212. A cam roller 223 attached to the lower end 214*b* of each plunger 214 is biased toward the fuel cam 224 by means of a plunger spring 222. The plunger 214 is adapted to be moved reciprocatingly by the action of rotary fuel cam 224 and the resilient biasing force exerted by the plunger spring 222.

A radial through bore 219*a* is formed at an intermediate portion 214*c* of the plunger 214. A pin 219 is inserted into the through bore 219*a* from one side of the latter, such that one end thereof project outward from the outer peripheral surface of the plunger 214 by a suitable length. The projecting portion of this pin 219 constitutes a projection 219*b* which is adapted to engage with a plunger rotating member 217 of a later-mentioned plunger rotating mechanism 230. Both side surfaces of the projection 219*b* are flattened to present sliding surfaces extending in the axial direction of the plunger.

Figure 18:
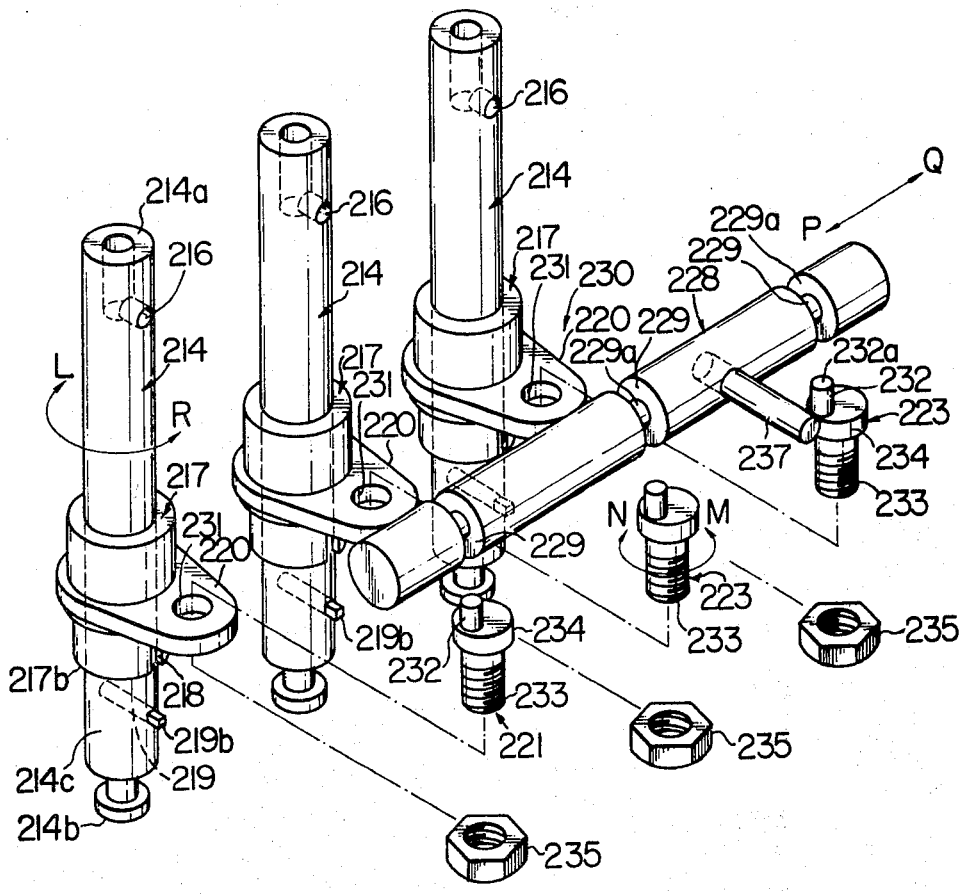
FIG. 18 is an exploded perspective view of a plunger rotating device.

As will be understood from FIG. 18, the plunger rotating mechanism 230 includes a plunger rotating member 217 fitting around each plunger 214, a fuel adjusting rod 228 for rotating the plunger rotating members and eccentric pins 221 by means of which the fuel adjusting rod 228 is connected to respective plunger rotating members 217.

Each plunger rotating member 217 has a cylindrical body of a suitable length, with its inner peripheral surface slidably fitting around the plunger 214. At one side of the lower portion of the plunger rotating member 217, formed is a vertical groove 218 of a suitable length opening in the lower end surface 217*b* of the plunger rotating member. The aforementioned projection 219*b* formed on one side of the plunger 214 is received by the vertical groove 218 in such a manner as to be able to slide in the axial direction of the plunger. The height or length of this vertical groove is selected to be slightly greater than the stroke of the vertical reciprocating movement of the plunger 214. The vertical groove 218 and the projection 219*b* engage with each other in the circumferential direction, so that the plunger 214 is rotated as a unit with the plunger rotating member 217 as the latter is rotated. A reference numeral 220 designates a lever member inserted into an intermediate portion of the plunger rotating member 217. The lever member 220 is unitarily fixed to the plunger rotating member 217. A bolt hole 231 for attaching a later-mentioned eccentric pin 221 is formed in the free end of the lever member 220.

The eccentric pin 221 is constituted by an upper pin member 232 and a lower pin member 233 which are offset suitably from each other, and a flange portion 234 by means of which the upper and lower pin members 232 and 233 are connected to each other. The lower pin member 233 has an outside diameter suitable for fitting in the bolt hole 231 formed in the lever member 220 of the plunger rotating member 217, and is threaded externally. The upper pin member 232 has a diameter smaller than that of the lower member and constitutes an engaging portion for engaging a later-mentioned fuel adjusting lever 228. In assembling, the lower pin member 233 is inserted into the bolt hole 231 of the lever member 220 from the upper side of the latter, and a nut 235 is screwed to the end of the lower pin member 233 projecting from the lower surface of the lever member 220 to connect the eccentric pin 221 to the lever member 220. The eccentric pin 221 is allowed to be rotated in the direction of arrows M-N as the nut 235 is loosened.

The fuel adjusting lever 228 is constituted by a rod member of a suitable length, and is provided three peripheral grooves 229 formed in the peripheral surface thereof at a suitable pitch in the axial direction thereof. Each of these peripheral grooves 229 is adapted to receive the upper pin member 232 of the eccentric pin 221 of the corresponding pump unit 211A to make the eccentric pins 221 engage with the fuel adjusting rod 228 in the axial direction of the latter. The width and depth of the peripheral groove 229 are suitably selected in accordance with the size of the upper pin member 232. The pitch of the peripheral grooves 229 in the axial direction of the fuel adjusting lever is determined to match the pitch of the axes of the plungers of the pump units 211A.

Figure 19:
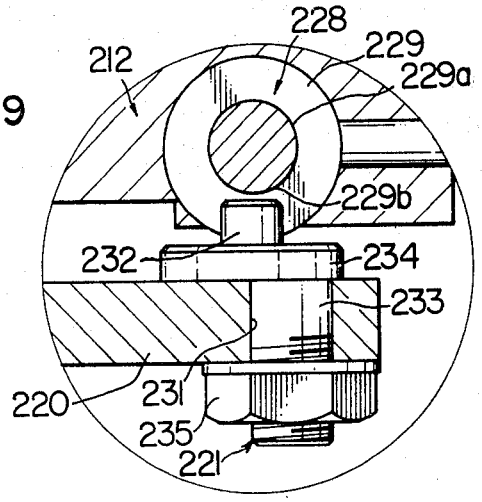
FIG. 19 is an enlarged view of a portion marked at XIX in FIG. 17.

As will be seen from FIG. 19, the positions of the fuel adjusting rod 228 and the eccentric pins 221 are so determined that, when the upper pin member 232 is received by the corresponding peripheral groove 229, the upper end surface 232*a* of the upper pin member 232 is positioned below the lower end 229*b* of the bottom 229*a* of the peripheral groove 229. This fuel adjusting rod 228 is slidably received by a rod receiving portion 236 provided in the pump casing 212, in such a manner as to be able to slide in the axial direction thereof, and is adapted to be moved back and forth in the directions of the arrows P-Q, by means of a governor (not shown) through the medium of an operating pin 237 which projects radially from the fuel adjusting rod 228.

The fuel injection pump of the described embodiment operates in a manner explained hereinbelow. As the fuel cam 224 is rotated, the plunger 214 is reciprocatingly moved in the plunger receiving bore 213*b* of the barrel 213 so as to pressurize the fuel in the fuel pressurizing chamber 213*a* and to deliver the pressurized fuel to a fuel injection valve through the delivery valve 225. As the engine speed is changed for any reason, the governor operates to move the fuel adjusting rod 228 in the axial direction (direction of arrow P-Q). Consequently, in each fuel injection pump unit 211A, the plunger rotating member 217 is rotated in the direction of arrows R-L through the medium of the eccentric pin 221, in accordance with the axial displacement of the fuel adjusting rod 228. As a result, the plungers 214 of all units 211A are simultaneously rotated in the same direction, because of mutual engagement between the vertical groove 218 in the plunger rotating member 217 and the projection 219*b* of the plunger 214 in each pump unit.

In consequence, the timing of establishment of communication between the fuel relief bore 216 of the plunger 214 and the fuel relief port 215 of the barrel 213 is changed because of a change in the relative rotational position between the barrel and the plunger, so that the rate of delivery of the fuel is increased or decreased to recover the set engine speed.

In this fuel injection pump, for adjusting the fuel delivery rate of each pump unit to uniformalize the rate of fuel delivery of all pump units 211A, the nut 235 associated with the eccentric pin 221 of one of the pump units 211A is loosened and the eccentric pin 221 is rotated in the direction of arrows M-N by a suitable angle. As a result, the relative position of the plunger rotating member 217, relatively to the peripheral groove 229 of the fuel adjusting rod 228, in the direction of arrows P-Q, is changed because the lower pin member 233 is offset from the upper pin member 232. In this state, one pump unit 211A can be adjusted independently of the other pump units. By effecting this adjustment to other pump units, the fuel delivery rates of all pump units can be uniformalized.

In addition, since the eccentric pin 221 is positioned relatively to the peripheral groove 229 of the fuel adjusting rod 228 such that the upper end surface 232*a* of the upper pin member 232 is positioned below the lower end portion 229*b* of groove bottom of the peripheral groove 229, the upper end surface 232*a* is never interferred by the bottom 229*b* of the peripheral groove 229 however the eccentric pin 221 may be rotated. This arrangement permits a wide range of adjustment of fuel delivery rate for each pump unit.

As has been described, in the fuel injection pump of this embodiment, the pins of the plunger rotating lever members are received by the peripheral grooves formed in the fuel adjusting lever, so that the axial displacement of the fuel adjusting rod is converted into the rotational displacement of the plunger. Therefore, the construction of the plunger rotating mechanism is much simplified as compared with the conventional one employing a combination of a rack and pinion.

In addition, since the upper pin member of the plunger rotating lever member is positioned such that its upper end is positioned below the lower end of the groove bottom of the peripheral groove formed in the fuel adjusting rod, the eccentric pin is never interferred by the groove bottom when it is rotated however the rotation angle may be large, so that it is possible to preserve a wide range of adjustment of the fuel delivery rate.

Figure 20:
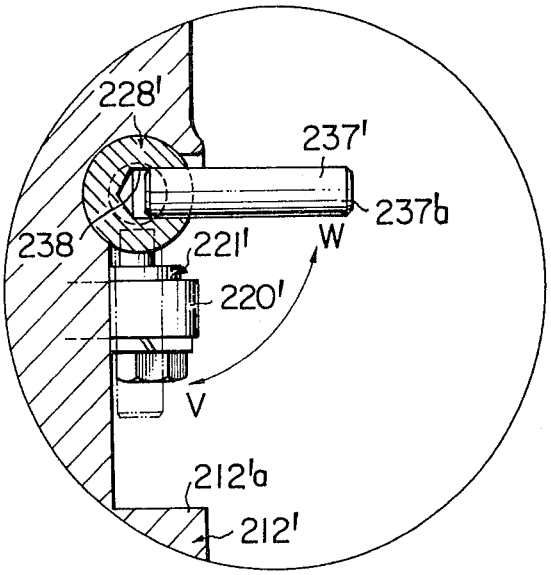
FIG. 20 is an enlarged sectional view of an essential part of a fuel injection pump constructed in accordance with a seventh embodiment of the invention.

FIG. 20 shows a seventh embodiment of the invention which relates to an improvement in the construction of the fuel adjusting rod of the multi-barrel type fuel injection pump of the sixth embodiment. More specifically, in this seventh embodiment, the operating pin of the fuel adjusting rod is arranged to freely come into and out of the pump casing to realize the compact construction of the fuel injection pump to facilitate the packaging, while avoiding the breakage of the operating pins during disassembling, assembling and packaging of the fuel injection pump.

The fuel injection pump of this embodiment is materially identical to the sixth embodiment shown in FIGS. 16 through 19, except the construction of the operating pin. The explanation of the same portions as the sixth embodiment, therefore, is omitted. In FIG. 20, the parts same as those of the sixth embodiments are denoted by the same reference numerals having a suffix '. A reference numeral 228' denotes a fuel adjusting rod similar to that of the sixth embodiment. An operating pin 237' is attached to the fuel adjusting rod between two adjacent peripheral grooves so as to extend radially outwardly. This operating pin is forcibly fitted in an attaching bore 238 formed in the fuel adjusting rod 228'. The operating pin 237' is allowed to rotate together with the fuel adjusting rod 228' between a first position (showed by full line) at which it intersects the axis of the plunger at a right angle and a second position (shown by chain line) at which it extends in parallel with the axis of the plunger, as designated at arrows V-W. When the fuel injection pump is mounted on the engine, the operatling pin 237' is rotated to the full-line position to make its end 237'*a* project outwardly from the opening 212'*a* of the pump casing 212' to permit the same end to be connected to the link mechanism of a governor. However, when the fuel injection pump is packaged for a transportation or the like purpose, the operating pin 217' is rotated to the position of chain line and concealed behind the opening 212'*a* of the pump casing 212'.

Since the fuel adjusting rod 228' is allowed to roate to make it possible to accomodate the operating pin 237' in the pump casing 212', there is no fear that the operating pin 237' collides with or be caught by another object during the disassembling/assembling and transportation of the fuel injection pump. In addition, the operating pin is retracted into the pump casing so that the package as a whole is made compact considerably.

Hereinafter, an explanation will be made as to an eighth embodiment of the invention with specific reference to FIG. 21.

In the case where the fuel adjusting rod of the fuel injection pump has a round bar-like form as in the case of the sixth embodiment, the fuel adjusting rod is made to slide as smoothly as possible to provide the control of fuel at a high sensitivity to the condition of operation of the engine. If there is no means for preventing the axial dropping of the fuel adjusting rod in the assembled state, the fuel adjusting rod may be accidentally dropped to be damaged, resulting in an increased resistance against the sliding motion and, hence, a deterioration in the sensitivity of the fuel adjustment. To the contrary, if any means are employed for preventing the accidental dropping of the fuel adjusting rod, the number of parts is increased correspondingly to increase the number of steps of the production process resulting in a raised cost of production.

Under this circumstance, this embodiment is arranged to make use of a part of the pump casing as a member for preventing the dropping of the fuel adjusting rod during disassembling/assembling of the fuel injection pump, thereby to prevent the dropping of the fuel adjusting rod to avoid any damage of the latter, without being accompanied by an increase of the number of parts.

Figure 21:
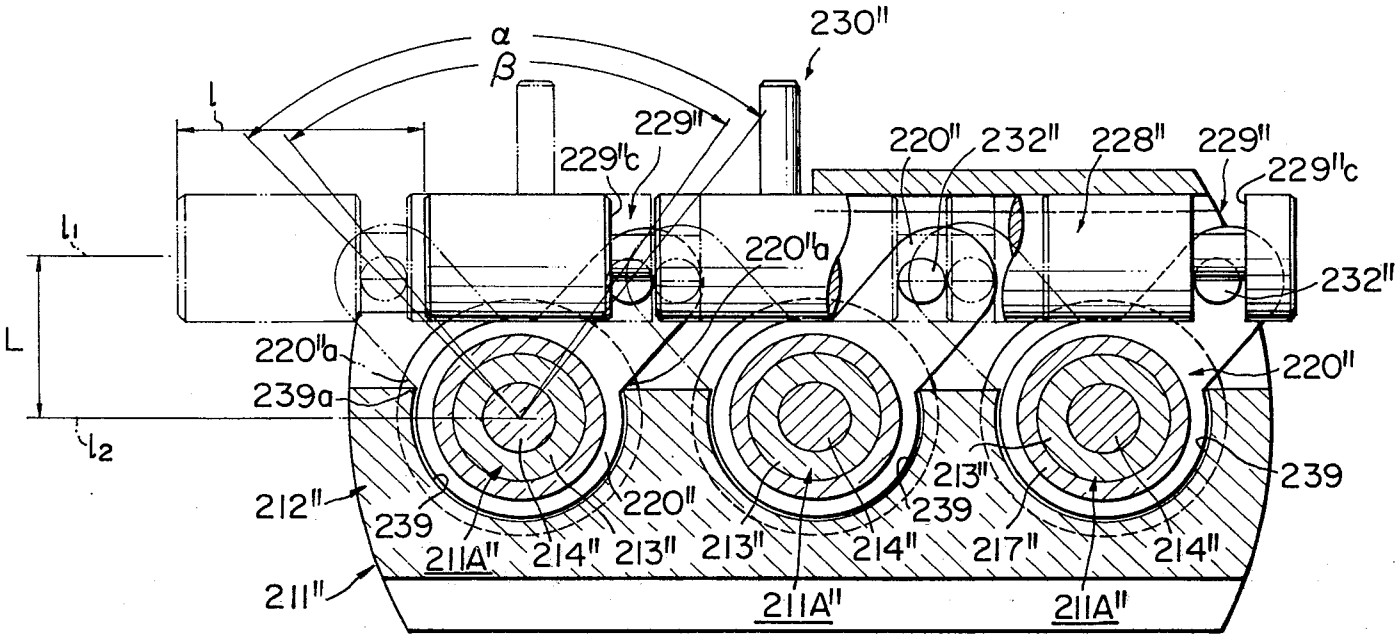
FIG. 21 is an enlarged sectional view of an essential part of a fuel injection pump constructed in accordance with an eighth embodiment of the invention.

The fuel injection pump of the eighth embodiment is materially identical to the sixth embodiment excepting the construction shown in FIG. 21. Namely, FIG. 21 shows in section a plunger rotating mechanism, in which the same reference numerals with suffix " are used to denote the same parts as the sixth embodiment.

In order to make use of a part of the pump casing 212" as a drop prevention member for preventing the accidental dropping of the fuel adjustment rod during the assembling/disassembling of the fuel injection pump, the distance L between the axis $l_1$ of the fuel adjusting rod and the common axis line $l_2$ of the pump units 211A" is determined as follows. Namely, the distance L is selected such that, when the lever member 220" is fully swung by a full angular stroke (rotation angle $\alpha$) between the outer extreme positions at which respective sides 220''*a* of the lever member 220 abut corresponding edges 239*a* of the plunger rotating member insertion opening 239 formed in the pump casing, the engagement between the upper pin member 232'' of the eccentric pin 221'' attached to the end of the lever member 220'' and the side wall 229''*c* of the peripheral groove 229'' of the fuel adjusting rod 228'' is maintained safely. By so doing, the fuel adjusting rod 228'' is allowed to move only within the axial distance l corresponding to the axial displacement of the fuel adjusting rod which in turn is determined by the range of angular displacement of the lever member 220''. A further displacement is limited by the upper pin member 232'', because the rotation of the lever member 220'' is restricted by the edges 239*a* of the plunger rotating member receiving bore 239. That is, the edges 239*a* of the opening 239 act as stoppers for preventing accidental dropping of the fuel adjusting rod 228''.

For information, the lever member 220'' is swung by an angle $\beta$ which is smaller than the aforementioned angle $\alpha$, during the operation of the fuel injection pump.

Thus, in the fuel injection pump of this embodiment, the pin attached to the end of the lever member, whose rotation angle is limited by the edges of the plunger rotating member receiving bore, is ensured to maintain its engagement with the peripheral groove wall of the fuel adjusting rod even when the lever member is swung fully, so that the fuel adjusting rod is prevented from being dropped accidentally during the disassembling/assembling of the fuel injection pump. Accordingly, the necessity for the specific drop-prevention member is eliminated to permit a reduction of number of parts, so that the cost of the fuel injection pump as a whole is remarkably reduced while effectively preventing the accidental dropping of the fuel adjusting rod to ensure a safe fuel adjusting operation of the fuel injection pump over a long period of time.

Figure 22:
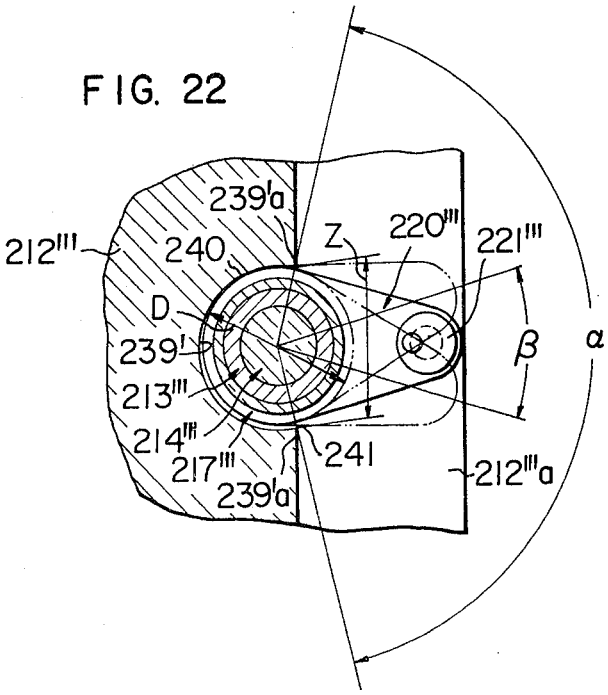
FIG. 22 is an enlarged sectional view of an essential part of a fuel injection pump constructed in accordance with a ninth embodiment of the invention.

FIG. 22 shows a nineth embodiment of the invention which is materially identical to the sixth embodiment except the construction shown in FIG. 22. FIG. 22 shows in section the plunger rotating mechanism of the nineth embodiment, in which the same reference numerals with suffix ''' are used to denote the same parts as those of the sixth embodiment.

More specifically, this embodiment is concerned with a multi-barrel type fuel injection pump and, more particularly, with an improvement in the fuel metering mechanism for metering the fuel to be injected by the fuel injection pump of the kind described. The characteristic feature of this embodiment resides in that the fuel metering mechanism is simplified without being accompanied by a substantial deterioration of the rigidity of the pump casing.

As will be seen from FIG. 22, the width Z of the bore 239' for receiving the plunger rotating member 217''' is selected to be smaller than the outside size D of the sliding surface 240 of the plunger rotating member 217''', the circumferential edges 239'*a* of the bore 239' for receiving the plunger rotating member 217''' serve as guiding surfaces for guiding the plunger rotating member and as a member for preventing dropping toward the opening 241, during the assembling of the fuel injection pump. In addition, during the operation of the fuel injection pump, it is possible to stably operate and rotate the plunger rotating member 217''' within the bore 239'. It is possible to suitably select the angle $\alpha$ of opening of the bore 239' such that the circumferential edges 239'*a* of the bore 239 receiving the plunger rotating member serve as stoppers for limiting the maximum angle of rotation of the lever member 220'''. By so doing, the maximum rate of fuel delivery is limited by the edges 239'*a* so that it becomes not necessary to employ any specific member for limiting the maximum fuel delivery rate to permit a reduction of number of parts.

As has been described, in this embodiment, the width of opening formed in the side wall of the plunger rotating member receiving bore is selected to permit the lever member of the plunger rotating member to rotate within a predetermined rotation angle, so that the edges of the opening acts as stoppers for preventing excessive rotation of the lever member. In addition, since the width of the opening is reduced to the minimum required size, the rate of area of the opening to the whole pump casing is minimized to ensure a sufficiently high rigidity of the pump casing.

Figure 23:
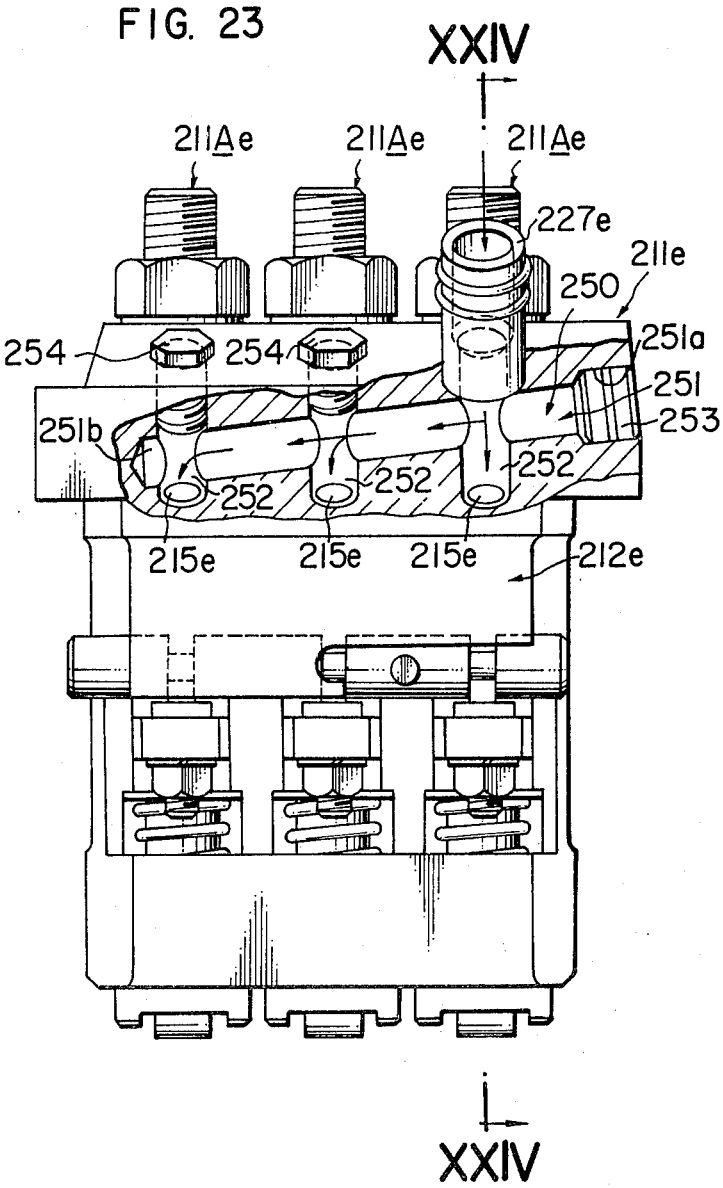
FIG. 23 is a sectional front elevational view of a tenth embodiment of the invention.
Figure 24:
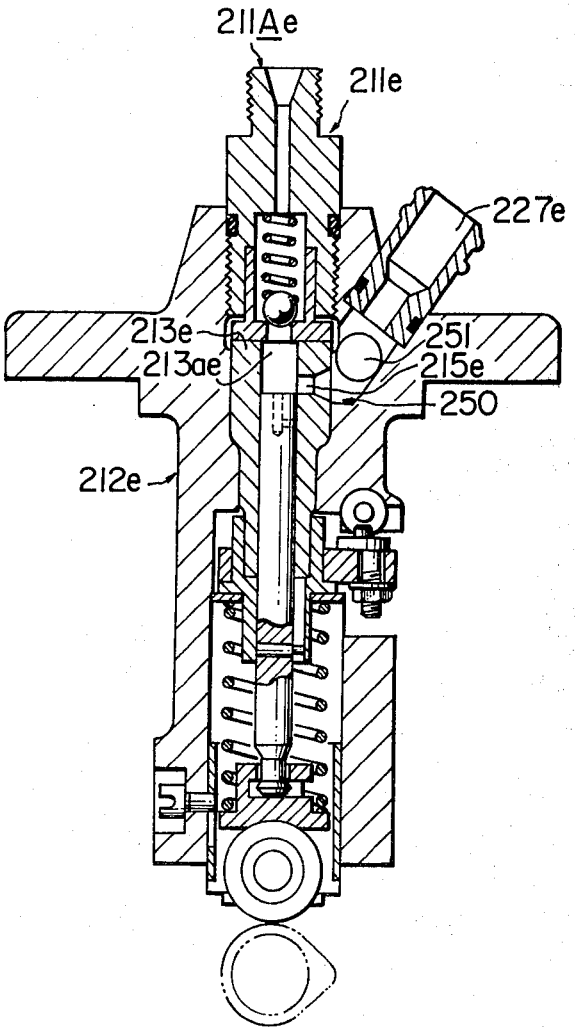
FIG. 24 is a sectional view taken along the line XXIV—XXIV of FIG. 23.

FIGS. 23 and 24 show a tenth embodiment of the invention relating to an improvement in the construction of fuel passage device in the multi-barrel type fuel injection pump of the sixth embodiment. More specifically, this embodiment has a fuel passage device which is arranged permit the voids or air bubbles in the fuel system to be removed by the buoyancy of these bubbles.

Other portions than this fuel passage device are identical to those of the sixth embodiment, so that the detailed description thereof is omitted. In FIGS. 23 and 24, the same reference numerals with suffix "e" are used to denote the same parts or members as those of the sixth embodiment.

A fuel passage device 250 is formed at one side of the barrel 213*e* of each pump unit 211A*e*. The fuel passage device 250 is constituted by three branch fuel passages 252 formed from the outer surface of the pump casing 212*e* toward the fuel relief ports 215*e* of respective barrels vertically at an inclination and a main fuel passage 251 extending laterally from the branch fuel passage 252 of one end to the branch fuel passage 252 of the other end to provide mutual communications of all branch fuel passages. The main fuel passage 251 is inclined upwardly at a slight inclination angle from one closed end 251*b* to the other opened end 251*a*. The opened end 251*a* of the main fuel passage 251 is plugged by a priming plug 253. The fuel suction pipe 227*e* is connected to the opened end of one of the branch fuel passage closer to the opened end 251*a* of the main fuel passage, while the opened ends of the other branch fuel passages are closed by plugs 254. Therefore, the fuel supplied from the fuel suction pipe into the fuel passage device 250 flows into the fuel pressurizing chambers 213*ae* through the main fuel passage 251, branch fuel passages 252 and fuel relief ports 215*e* of respective pump units 211A.

In this fuel injection pump 211*e*, since the main fuel passage 251 is formed at an upward inclination from the closed end 251*b* toward the opened end 251*a* thereof, the air separated from the fuel in the fuel system in the pump casing 212*e* naturally moves due to buoyancy toward the highest portion of the fuel passage device 250, i.e. toward the opened end 215*a* of the main fuel passage, and stays at this end. Therefore, by loosening the priming plug 253 fitting the opened end 251*a* of the main fuel passage, it is possible to easily relief the air from the fuel system. Thus, this embodiment offers an advantage that the priming is achieved easily.

What is claimed is:

1. A fuel injection pump for internal combustion engines of the type having a plunger with a unitary diameter adapted to be reciprocatingly moved within a barrel which also serves as a pump body to pressurize and deliver a fuel before establishment of communication between a fuel relief port formed in a wall of said barrel and a fuel pressurizing chamber, said plunger being adapted to be rotated relative to said barrel to change timing of establishment of said communication thereby to adjust an amount of the fuel delivered per stroke of said plunger, characterized by a plunger rotating member rotatably mounted in a lower end of said barrel and coupled to said plunger for rotation together with said plunger, and a plunger spring coupled to a lower end of said plunger spaced from the lower end of said barrel such that a portion of said plunger surrounded by said plunger spring and said plunger spring extend downwardly from the lower end of said barrel and exposed exteriarly, and further wherein said plunger is provided with a pin radially projecting outward from the outer peripheral surface of said plunger located adjacent the lower end of said barrel, and said plunger rotating member is provided with a single axial groove formed in an inner peripheral surface thereof which is in sliding contact with said plunger to receive said pin and axially guide the same.

* * * * *